US006356251B1

(12) United States Patent
Naito et al.

(10) Patent No.: US 6,356,251 B1
(45) Date of Patent: Mar. 12, 2002

(54) MATRIX TYPE LIQUID-CRYSTAL DISPLAY WITH OPTICAL DATA COMMUNICATION FEATURE

(75) Inventors: Susumu Naito, Kariya; Toshiki Itoh, Nagoya, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/294,899

(22) Filed: Apr. 20, 1999

(30) Foreign Application Priority Data

Apr. 22, 1998 (JP) ..... 10-112438
Sep. 1, 1998 (JP) ..... 10-247535
Mar. 11, 1999 (JP) ..... 11-65345

(51) Int. Cl.[7] ..... G09G 3/34

(52) U.S. Cl. ..... 345/81; 345/76; 345/80; 345/84; 345/207; 345/87; 359/114; 359/152; 359/154; 315/169.1; 315/169.3

(58) Field of Search ..... 345/87, 91, 98, 345/100, 207, 76, 80, 84; 359/111, 114, 131, 152, 154, 158, 159, 173; 455/150.1, 152.2, 296, 306; 315/169.1, 169.3

(56) References Cited

U.S. PATENT DOCUMENTS 3,947,842 A * 3/1976 Hilsum et al. ..... 345/81
4,467,325 A * 8/1984 Lustig ..... 345/207
5,801,860 A * 9/1998 Yoneyama ..... 359/124
5,815,296 A * 9/1998 Kubota ..... 359/133
5,844,638 A * 12/1998 Ooi et al. ..... 349/10
5,886,802 A * 3/1999 Majima ..... 359/124
5,917,968 A * 6/1999 Wood ..... 385/15
5,923,339 A * 7/1999 Date et al. ..... 345/505
6,215,462 B1 * 4/2001 Yamada et al. ..... 345/76

FOREIGN PATENT DOCUMENTS

JP 8-16131 1/1996
JP 8-46385 2/1996

OTHER PUBLICATIONS

Suzuki, "FPD Expo Tutorial Seminar", May 28, 1997, pp. 26–38.

* cited by examiner

*Primary Examiner*—Richard Hjerpe
*Assistant Examiner*—Henry N. Tran
(74) *Attorney, Agent, or Firm*—Pillsbury Winthrop

(57) ABSTRACT

A matrix type display is provided in which information is transmitted to a flat panel display element such as a liquid crystal or electroluminescent panel utilizing optical communication. Synchronization signals are transmitted from a synchronization circuit to scan electrode driving circuits through optical communication utilizing a plurality of pairs of light-emitting elements and light-receiving elements facing each other, and image data is transmitted from a memory circuit to signal electrode driving circuits through non-interfering optical communication signals utilizing a plurality of opposing pairs of light-emitting elements and light-receiving elements.

20 Claims, 17 Drawing Sheets

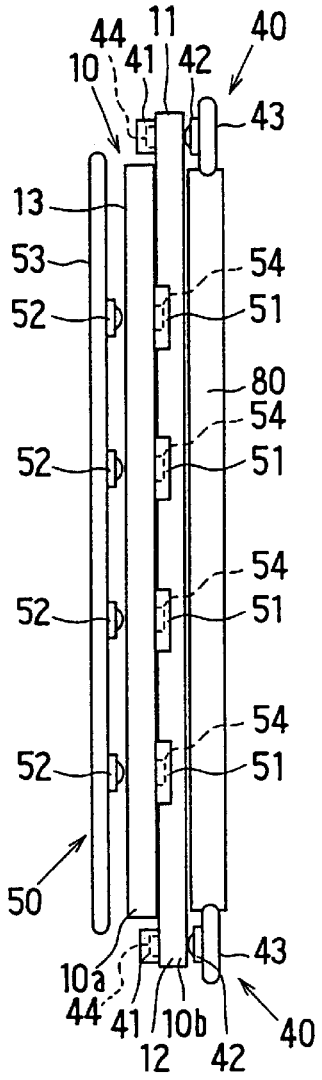
FIG. 4
FIG. 5
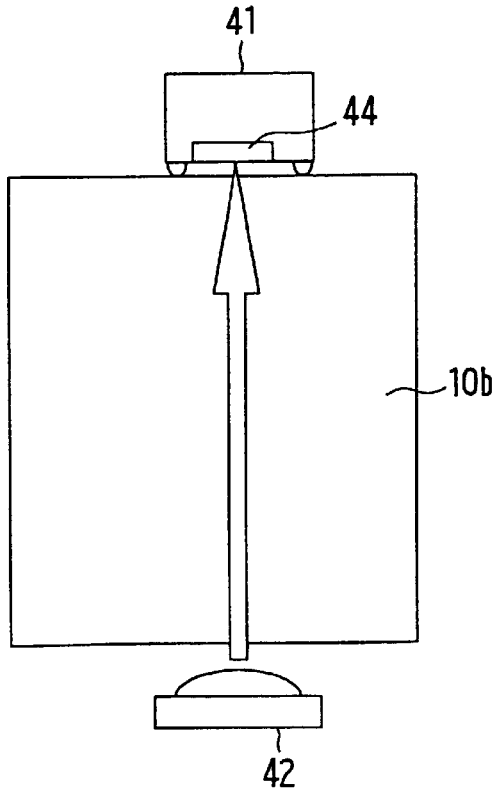

MATRIX TYPE LIQUID-CRYSTAL DISPLAY WITH OPTICAL DATA COMMUNICATION FEATURE

CROSS-REFERENCE TO RELATED APPLICATIONS

This application is related to, and claims priority from, Japanese Patent Application Nos. Hei. 10-112438, 10-247,535 and 11-65345, the contents of which are incorporated herein by reference.

BACKGROUND OF THE INVENTION

1. Field of the Invention

The present invention relates to matrix type displays, and more particularly to a matrix display having a flat panel display element such as a liquid crystal panel or electroluminescent panel driven by non-interfering optically communicated signals.

2. Description of the Related Art

A flexible substrate such as a tape carrier package is frequently used for electrical connection between a liquid crystal panel and a substrate for external circuits of a matrix type liquid crystal display. When the liquid crystal panel and the substrate are electrically connected by the flexible substrate, the liquid crystal panel and the flexible substrate must be electrically connected, as well as the flexible substrate and the substrate for external circuits, thereby increasing the complexity of the assembly process and the cost of the resulting display.

Liquid crystal displays including that disclosed in Japanese unexamined patent publication No. Hei. 8-16131 have been proposed in view of the above drawbacks by transmitting signals between a liquid crystal panel and a substrate for external circuits using light. As a result, the above electrical connections can be eliminated, thereby significantly reducing the cost of a liquid crystal display.

However, recent trends require liquid crystal panels having larger screens (higher definition) and greater amounts of displayed information, thereby necessitating an increase in the current signal transmission capacity for XGA (1024×768 dots) and SXGA (1280×1024 dots) standards to a value that can support full color display according to UXGA (1600×1200 dots) standard. As a result, high-density transmission-reception pairs will be required not only for signal transmission based on electrical connection but also for the transmission of optical signals. The apparatus disclosed in the above-cited publication may exhibit certain limitations when it has a high density transmission-reception pair configuration, as no consideration is paid to signal interference between adjacent signal transmission paths.

SUMMARY OF THE INVENTION

It is therefore an object of the invention to provide an active matrix type display in which information is optically transmitted to a flat panel display element, such as a liquid crystal or electroluminescent panel, and which can accommodate increased amounts of display information.

To achieve the above-described object, the present invention includes a matrix type display comprising a flat panel display element. Driving systems including a plurality of pairs of light-emitting elements and light-receiving elements are disposed around the display element for driving a matrix of display elements in response to a light-reception signal generated by each of the light-receiving elements, based on light from each of the respective light-emitting elements generated in accordance with an image signal. Each of the plurality of pairs of light-emitting elements and light-receiving elements form signals transmission paths.

According to one embodiment of the present invention, the wavelength of the light emitted by the light-emitted element of one of each pair of adjacent signal transmission paths is different from the wavelength of the light emitted by the light-emitting element of the other signal transmission path. This prevents mutual optical interference between the pair of adjacent signal transmission paths to allow the matrix of display elements to be optically driven.

Also according another embodiment of the present invention, a matrix type display of the type described in the preceding two paragraphs is provided with an optical interference preventing member between the light-emitting element and light-receiving element of each of the signal transmission paths. This member allows the matrix of the display elements to be driven using optical communication while reliably preventing interference between each pair of adjacent signal transmission paths.

BRIEF DESCRIPTION OF THE DRAWINGS

FIG. 4 is a right side view of the liquid crystal panel;

FIG. 5 is a schematic view showing the positional relationship between a pair of light-emitting element and light-receiving element associated with each other and an end of a common electrode substrate in the first embodiment;

DETAILED DESCRIPTION OF PREFERRED EMBODIMENTS

Embodiments of the present invention will now be described with reference to the drawings.

Figure 1:
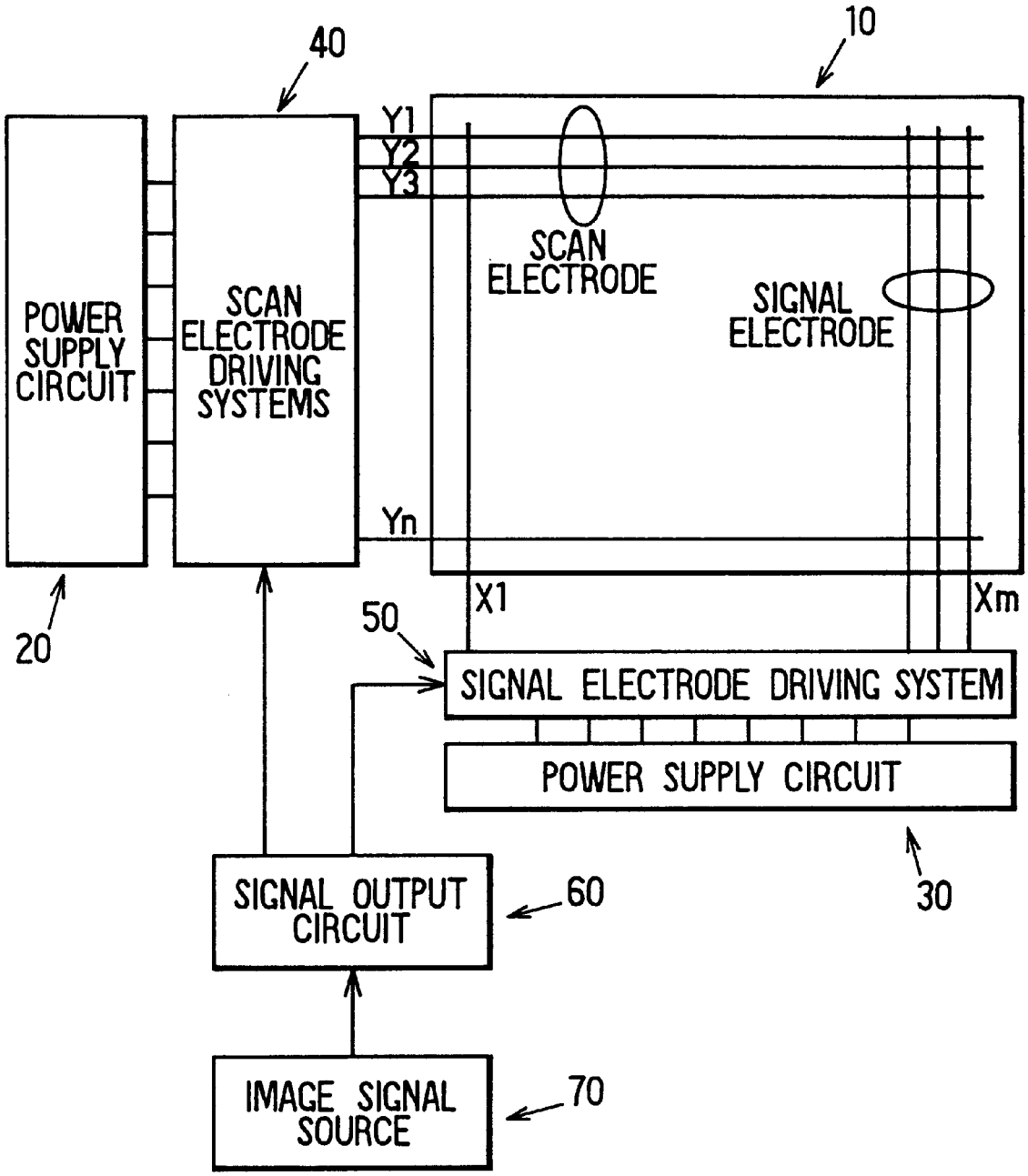
FIG. 1 is a block diagram showing a general configuration of a first embodiment of a liquid crystal display according to the present invention.

FIG. 1 shows a general circuit configuration representing a first embodiment of a matrix type liquid crystal display according to the present invention.

As shown in FIGS. 1 through 4, the liquid crystal display includes a liquid crystal panel 10. The liquid crystal panel 10 is configured by enclosing an antiferroelectric liquid crystal between a color filter electrode substrate (hereinafter CF electrode substrate) 10*a* and a common electrode substrate 10*b* and placing a polarizing plate (not shown) on the outer surface of each of the CF electrode substrate 10*a* and common electrode substrate 10*b*.

The CF electrode substrate 10*a* is configured by sequentially forming m stripes of color filter layers (R, G and B) and m stripes of transparent conductive films and an alignment film on the inner surface of a transparent glass substrate. The common electrode substrate 10*b* is configured by sequentially forming n stripes of transparent conductive films and an alignment film on the inner surface of a transparent glass substrate.

The m stripes of transparent conductive films and the n stripes of transparent conductive films are provided such that they cross each other to form m×n pixels in the form of a matrix in combination with the antiferroelectric liquid crystal. The m stripes of transparent conductive films correspond to m stripes of signal electrodes X1 through Xm shown in FIG. 1, and the n stripes of transparent conductive films correspond to n stripes of scan electrodes Y1 through Yn shown in FIG. 1. Both of the polarizing plates are applied such that the respective optical axes are set in a crossed Nicols position.

Figure 2:
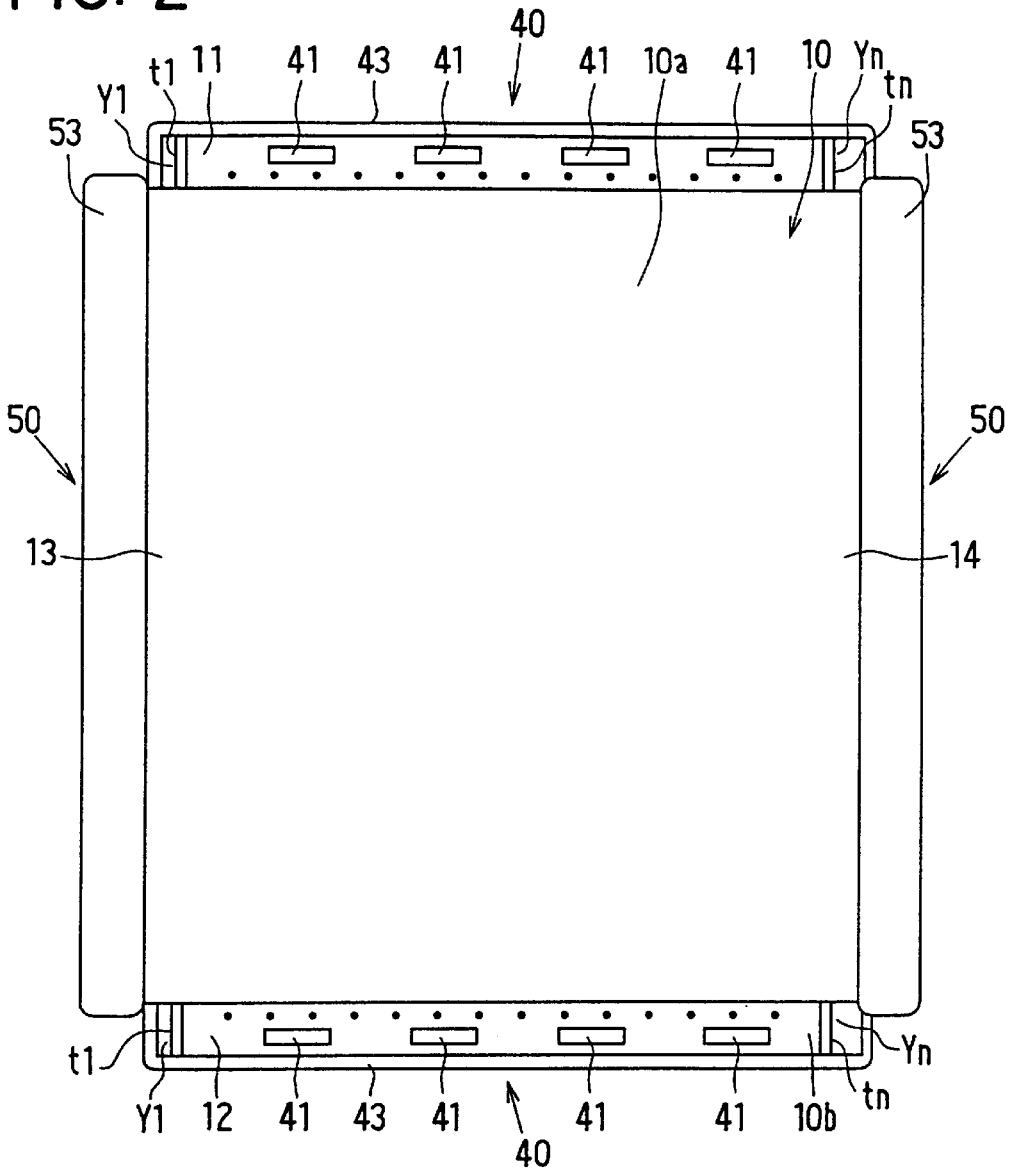
FIG. 2 is a plan view of the liquid crystal panel in FIG. 1.
Figure 6:
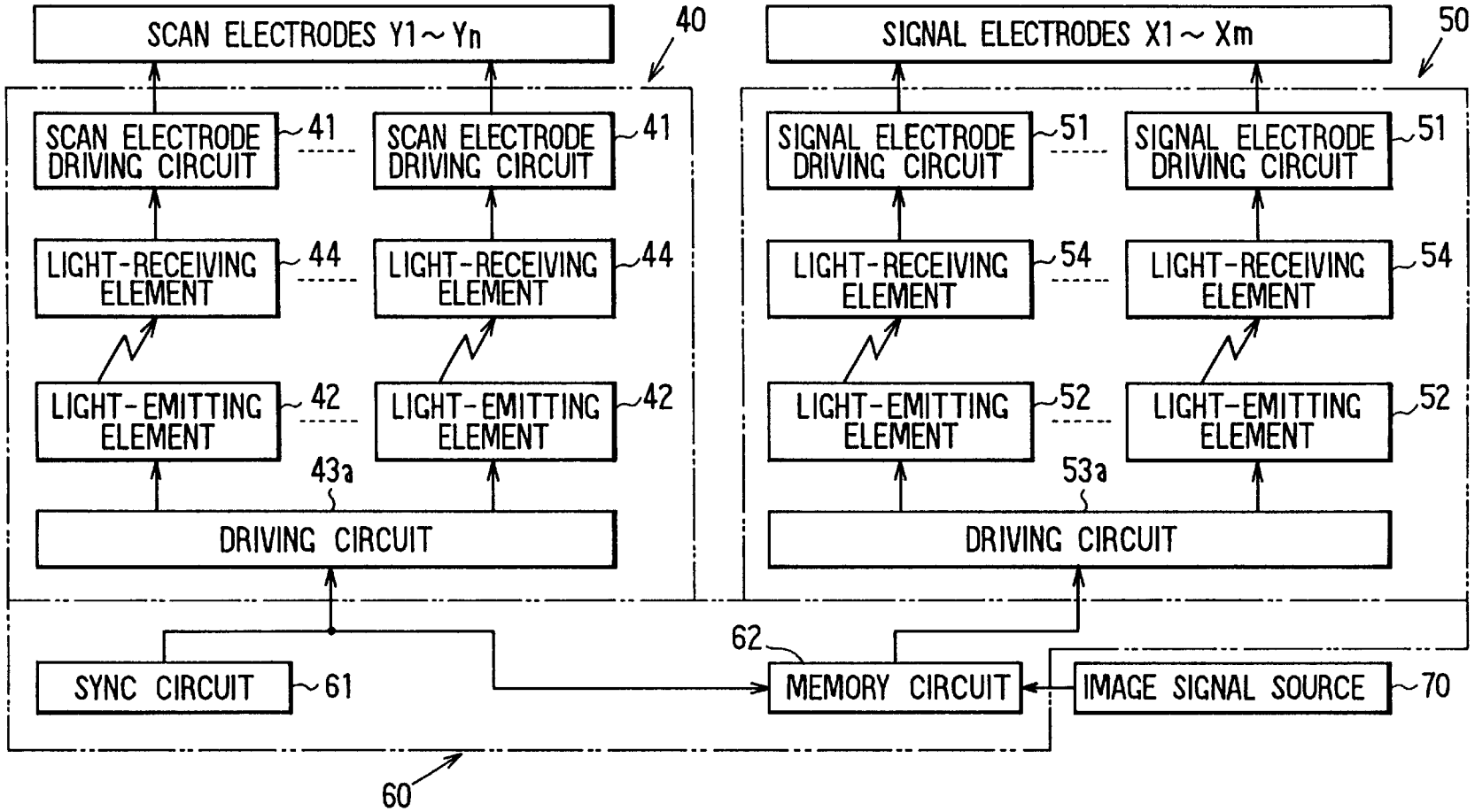
FIG. 6 is a detailed block diagram of the liquid crystal display in FIG. 1.

As shown in FIG. 1, the liquid crystal display includes two power supply circuits 20, 30, scan electrode driving systems 40 and signal electrode driving systems 50. Each of the power supply circuits 20, 30 generates a plurality of voltages. As shown in FIGS. 2, 4 and 6, the scan electrode driving systems 40 include a plurality of scan electrode driving circuits 41 configured as a whole to drive the scan electrodes X1 through Xn for scanning on a line sequential basis in accordance with a light-reception signal from each of light-receiving elements 44.

As shown in FIG. 2, four each of scan electrode driving circuits 41 are disposed on both of the upper and lower ends of the liquid crystal panel 10. The four each scan electrode driving circuits 41 are disposed on both of upper and lower ends 11, 12 of the common electrode substrate 10*b* in a face-to-face relationship with each other through the CF electrode substrate 10*a*, with connection terminals t1 through tn of the respective scan electrodes Y1 through Yn interposed therebetween. Thus, the scan electrode driving circuits 41 are electrically connected respectively to the connection terminals t1 through tn of the scan electrodes Y1 through Yn at connection terminals thereof.

Figure 3:
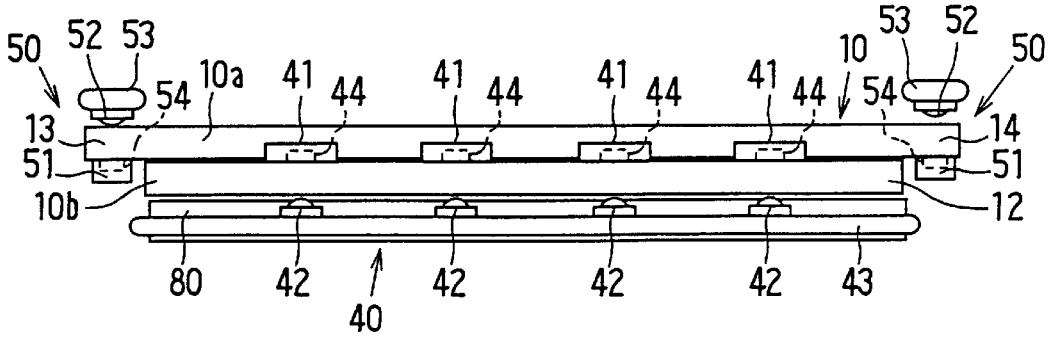
FIG. 3 is a bottom view of the liquid crystal panel.

As shown in FIGS. 3 and 4, the scan electrode driving systems 40 include a plurality of light-emitting elements 42. Four each light-emitting elements 42 are disposed on each of light emission driving circuit substrates 43 at both of the upper and lower ends of the liquid crystal panel 10 as viewed in FIG. 2.

According to the first embodiment, each of the plurality of light-emitting elements 42 of each of the scan electrode driving systems 40 on both of the upper and lower ends as viewed in FIG. 2 is a semiconductor laser. The semiconductor lasers that constitute each pair of adjacent light-emitting elements 42 emit laser beams in wavelength regions, which do not interfere with each other.

The light emission driving circuit substrates 43 are disposed on the rear side of the common electrode substrate 10*b* at each of the upper and lower ends 11, 12 thereof in parallel with each other. The light-emitting elements 42 provided on the light emission driving circuit substrates 43 are located in a face-to-face relationship with the respective scan electrode driving circuits 41 at light-emitting portions thereof, with the upper and lower ends of the glass substrate of the common electrode substrate 10*b* interposed therebetween. A light emission driving circuit 43*a* (see FIG. 6) on each of the light emission driving circuit substrates 43 drives respective light emitting elements 42.

As shown in FIG. 6, the scan electrode driving systems 40 include a plurality of light-receiving elements 44. The light-receiving elements 44 are provided in association with the respective scan electrode driving circuits 41 (see FIGS. 3 through 5). The light-receiving elements 44 are located in a face-to-face relationship with the respective light-emitting elements 42, with the upper and lower ends 11, 12 of the common electrode substrate 10*b* interposed therebetween. As a result, the light-receiving elements 44 receive laser light from the respective light emitting elements 42 through the upper and lower ends 11, 12 of the common electrode substrate 10*b*, as illustrated in FIG. 5, and generate light-reception signals output to internal circuits in the respective scan electrode driving circuits 41. Each of the plurality of light-receiving elements 44 has a light-receiving sensitivity, which enables the elements to receive laser light from the respective light-emitting element 42.

As shown in FIGS. 3, 4 and 6, the signal electrode driving systems 50 include a plurality of signal electrode driving circuits 51. The signal electrode driving circuits 51 as a whole output light reception data from respective light-receiving elements 54 to the respective signal electrodes X1 through Xm in synchronism with the line sequential scanning performed by the scan electrode driving systems 40 to drive the matrix of the liquid crystal panel 10 with the scan electrode driving systems 40.

Four each signal electrode driving circuits 51 are disposed on both of the left and right ends of the liquid crystal panel 10 as viewed in FIG. 3. The four each signal electrode driving circuits 51 are disposed on both of the left and right ends 13, 14 of the glass substrate of the CF electrode substrate 10*a* as viewed in FIG. 3 in a face-to-face relationship with each other through the common electrode substrate 10*b*, with respective connection terminals of the signal electrodes X1 through Xm interposed therebetween. Thus, the signal electrode driving circuits 51 are electrically connected to the connection terminals of the respective signal electrodes X1 through Xm.

As shown in FIGS. 3 and 4, the signal electrode driving systems 50 include a plurality of light-emitting elements 52, and four each of light emitting elements 52 are disposed on each of light emission driving circuit substrates 53 at both of the left and right ends of the liquid crystal panel 10.

In the first embodiment, each of the plurality of light-emitting elements 52 of the scan electrode driving systems 50 on both of the left and right sides as viewed in FIG. 2 is a semiconductor laser. The semiconductor lasers that constitute each pair of adjacent light-emitting elements 52 emit laser beams in wavelength regions, which do not interfere with each other.

The light emission driving circuit substrates 53 are disposed on the rear side of the CF electrode substrate 10*a* at each of the left and right ends 13, 14 thereof in parallel with each other. The light-emitting elements 52 provided on the light emission driving circuit substrates 53 are located such that they face the respective signal electrode driving circuits 51 at light-emitting portions thereof, with the left and right ends 13, 14 of the CF electrode substrate 10*a* interposed therebetween. A light emission driving circuit 53*a* (see FIG. 6) on each of the light emission driving circuit substrates 53 drives respective light emitting elements 52.

As shown in FIG. 6, the signal electrode driving systems 50 include a plurality of light-receiving elements 54 provided in association with the respective signal electrode driving circuits 51. The systems 50 face the light-emitting portions of the respective light-emitting elements 52 at light-receiving portions thereof, with the left and right ends 13, 14 of the CF electrode substrate 10*a* interposed therebetween. As a result, the light-receiving elements 54 receive laser light from the respective light emitting elements 52 through the left and right ends 13, 14 of the CF electrode substrate 10*a*, and generate light-reception signals output to internal circuits in the signal electrode driving circuits 51. Each of the plurality of light-receiving elements 54 has a light-receiving sensitivity, which allows preferable reception of laser light from the respective light-emitting elements 52.

As shown in FIG. 1, the liquid crystal display includes a signal output circuit 60, which includes a synchronization circuit 61 and a memory circuit 62 (FIG. 6).

The synchronization circuit 61 generates vertical and horizontal synchronization signals, which are output to light emission driving circuit 43*a* and memory circuit 62.

Figure 7A:
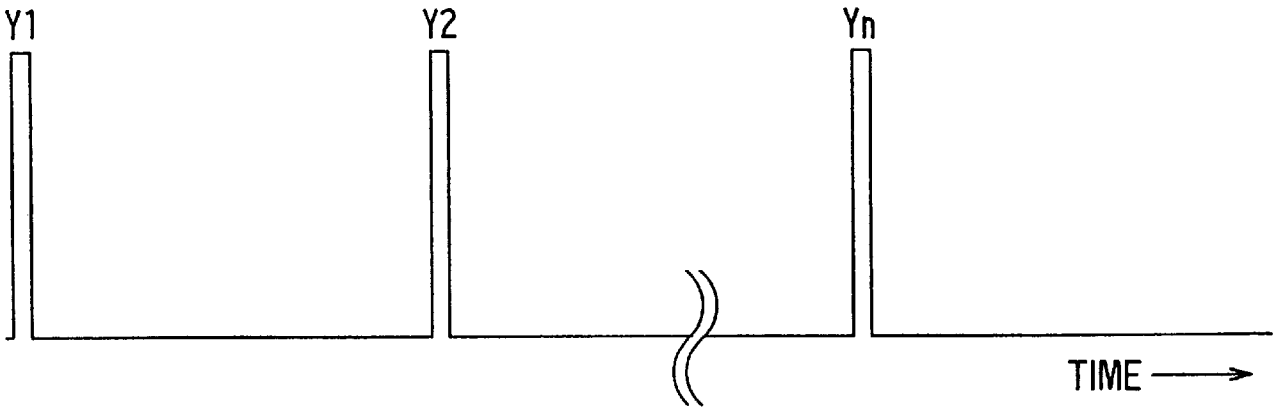
FIGS. 7A and 7B are timing diagrams of an optical synchronizing signal at a scan electrode and an optical data signal at a signal electrode, respectively.

As a result, the light emission driving circuit 43*a* drives the light-emitting elements 42 in synchronism with the vertical and horizontal synchronization signals from the synchronization circuit 61. Thus, the light-emitting elements 42 generate light-emission signals in the form of pulse-like laser beams as optical synchronization signals to the scan electrodes Y1 through Yn as shown in FIG. 7A.

In response to a light emission-driving signal from the memory circuit 62, the light emission driving circuit 53*a* drives the light-emitting elements 52. In this case, the beams from the light-emitting elements 52 are modulated by the light emission driving circuit 53*a* based on image data in the light emission-driving signal from the memory circuit 62.

Figure 7B:
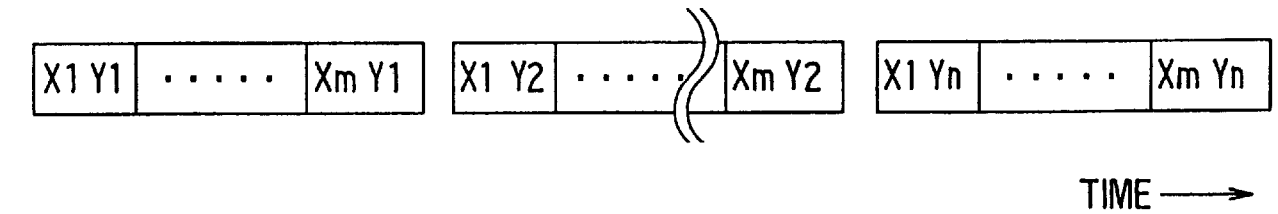
Figure 8:
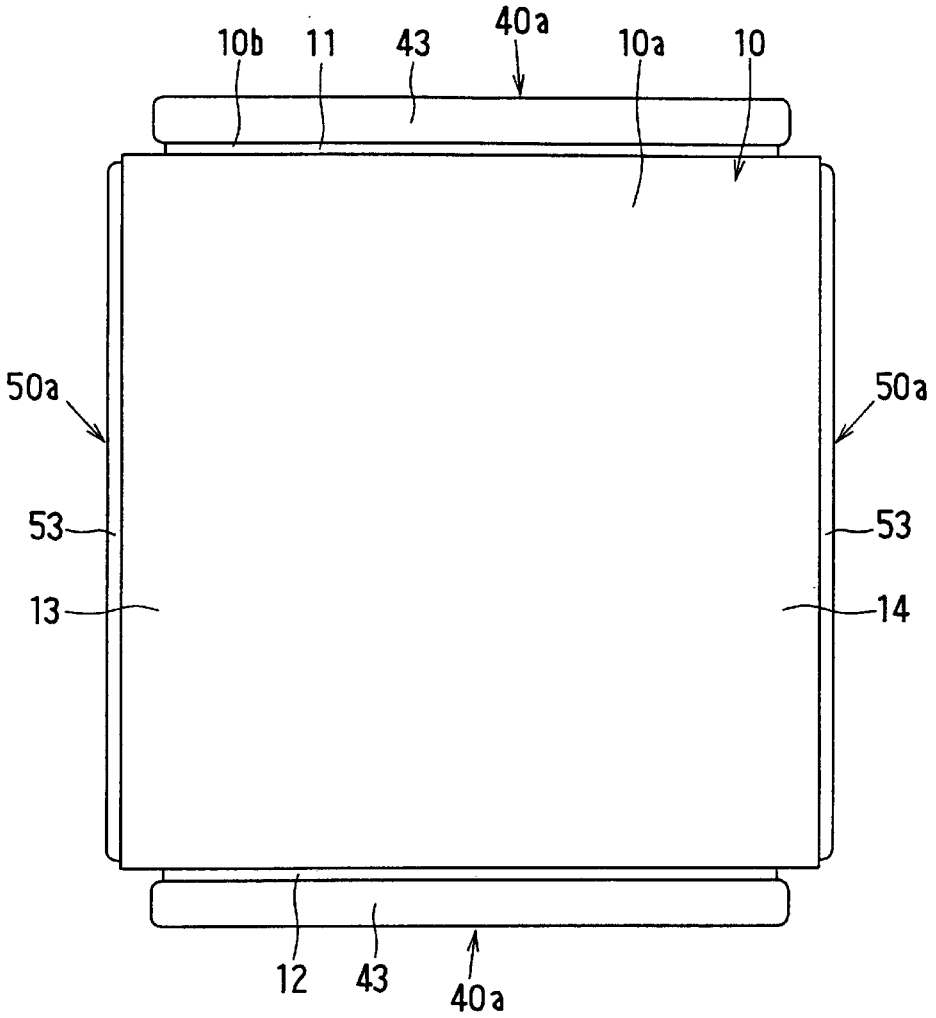
FIG. 8 is a plan view of a liquid crystal panel of a second embodiment of a liquid crystal display according to the present invention.

As a result, as shown in FIG. 7B, the light-emitting elements 52 sequentially output modulated beams as optical data signals to the signal electrodes X1 through Xm through the light-receiving elements 54 on a scan line by scan line basis in synchronism with the optical synchronization signals to the scan electrodes Y1 through Yn, thereby outputting image data for one screen.

In FIG. 7B, for example, the optical data signal associated with the scan electrode Y1 is represented by (X1Y1 . . . XmY1). When the above-mentioned modulation is pulse code modulation, a signal at about 100 MHz can be transmitted between a pair of light-emitting and light-receiving elements associated with each other.

The memory circuit 62 receives image signals representing R, G and B image data from an image signal source 70, stores them on a scan line by scan line basis and outputs the stored image data to the light emission driving circuit 53*a* as a light emission driving signal in synchronism with the vertical and horizontal synchronization signals from the synchronization circuit 61. In FIGS. 3 and 4, the reference number 80 represents a back light for the liquid crystal panel 10. FIG. 1 collectively shows each of the scan electrode driving systems 40 and signal electrode driving systems 50.

In the first embodiment having such a configuration, when the synchronization circuit 61 generates the vertical and horizontal synchronization signals, the light emission driving circuits 43*a* in the scan electrode driving systems 40 drive the respective light-emitting elements 42, and the light-emitting elements 42 generate optical synchronization signals in the form of laser beams.

Then, the light-receiving elements 44 receive the optical synchronization signals from the respective light-emitting elements 42 through the upper and lower ends 11, 12 of the common electrode substrate 10*b* to generate light-reception signals, and the scan electrode driving circuits 41 scan the scan electrodes X1 through Xn on a line sequential basis in accordance with the light-reception signals from the light-receiving elements 44.

The memory circuit 62 stores image signals from the image signal source 70 on a line by line basis and inputs the stored image data to the light emission driving circuits 53*a* as light emission driving signals in synchronism with the vertical and horizontal synchronization signals from the synchronization circuit 61. As a result, the light emission driving circuits 53*a* drive the light-emitting elements 52 based on the light emission driving signals. At this time, the beams from the light-emitting elements 52 are subjected to pulse code modulation based on image data in the light emission driving signals from the light emission driving circuits 53*a*.

In response to the reception of the modulated beams at the light-receiving elements 54, the signal electrode driving circuits 51 sequentially output optical data signals corresponding to the modulated beams to the signal electrodes X1 through Xm on a scan line by scan line basis in synchronism with the optical synchronization signals to the scan electrodes Y1 through Yn, thereby outputting image data for one screen.

When the scan electrode driving system 40 drives the scan electrodes Y1 through Yn for line sequential scanning and the signal electrode driving circuits 51 output image data to the signal electrodes X1 through Xm, the liquid crystal panel 10 shows a matrix display.

According to the first embodiment, the transmission of synchronization signals to the scan electrode driving circuits 41 is carried out through optical communication utilizing the plurality of pairs of light-emitting elements 42 and associated light-receiving elements 44, whereas the transmission of image data from the memory circuit 62 to the signal electrode driving circuits 51 is carried out through optical communication utilizing the plurality of pairs of light-emitting elements 52 and associated light-receiving elements 54.

This contributes to reduction of the manufacturing cost of liquid crystal displays, as complicated operations such as connecting external circuits to the liquid crystal panel 10 using a flexible substrate are eliminated.

Specifically, the use of optical communication makes it possible to keep the number of optical signals required for each of the scan electrode driving systems 40 and signal electrode driving systems 50, i.e., the number of the pairs of light-emitting elements and light-receiving elements, to a minimum. It is therefore possible to reduce the number of wires significantly from that in the case of the use of a flexible substrate as in the prior art. This results in packaging benefits, as the positioning accuracy of the light-emitting and light-receiving elements is low. In other words, the removal and replacement of the light-emitting and light-receiving elements can be easily carried out at the maintenance of the liquid crystal panel.

The above-described benefits are significant especially for a large screen liquid crystal panel, as there is no need for connections at fine pitches. In addition, the use of optical communication as described above makes it possible to increase the image data transmission capacity of a pair of light-emitting and light-receiving elements associated with each other significantly from that in the case of a flexible substrate as in the prior art.

In this case, there is small light attenuation because the distance between a pair of associated light-emitting and light-receiving elements can be very small, making it possible to provide a liquid crystal display having a desirable signal-to-noise ratio. Further, the use of optical communication makes it possible to achieve a desirable signal to electromagnetic wave noise ratio.

As described above, the scan electrode driving circuits 41 are disposed along with the associated light-receiving elements 44 on both upper and lower ends 11, 12 of the glass substrate of the common electrode substrate 10*b*, with the connection terminals t1 through tn of the respective scan electrodes Y1 through Yn interposed therebetween. Thus, the circuits are directly electrically connected to the connection terminals t1 through tn at connection terminals thereof. Also, the signal electrode driving circuits 51 are disposed with the associated light-receiving elements 54 on both of left and right ends of the glass substrate of the CF electrode substrate 10*a*, with the connection terminals of the respective signal electrodes X1 through Xm interposed therebetween. Thus, the circuits 51 are directly electrically connected to the connection terminals of the signal electrodes X1 through Xm at connection terminals thereof.

This significantly facilitates the electrical connection of the scan electrode driving circuits 41 to the scan electrodes Y1 through Yn and the electrical connection of the signal electrode driving circuits 51 to the signal electrodes X1 through Xm. Such an effect becomes more significant as the screen of the liquid crystal panel 10 becomes larger.

As described above, the first embodiment of the invention makes it possible to provide a matrix type display on which information can be transmitted to the liquid crystal panel thereof utilizing optical communication, and which can accommodate increased amounts of display information, i.e., information transmission at higher densities.

According to the first embodiment, laser light in one of adjacent pairs of light-emitting element 42 and light-receiving element 44 in a face-to-face relationship in the scan electrode driving system 40 does not interfere with laser beam in the other pair. Therefore, there is no mutual interference between the two optical synchronization signals.

FIGS. 8 through 12 show the second embodiment of the invention. In the second embodiment, scan electrode driving systems 40*a* and signal electrode driving systems 50*a* are utilized in place of the scan electrode driving systems 40 and signal electrode driving systems 50 described in the first embodiment.

The scan electrode driving systems 40*a* include light emission driving circuit substrates 43 and light emission driving circuits 43*a* of scan electrode driving systems 40 as described with reference to the first embodiment. Also, the systems 40*a* include scan electrode driving circuits 41*a*, light-emitting elements 42*a* and light-receiving elements 45 corresponding to the scan electrode driving circuits 41 of the scan electrode driving systems 40, the light-emitting elements 42 and light-receiving elements 44, respectively.

As apparent from FIGS. 9 and 10, instead of the scan electrode driving circuits 41 described with reference to the first embodiment, four each scan electrode driving circuits 41*a* are disposed on both of upper and lower ends 11 and 12 of a common electrode substrate 10*b* of a liquid crystal panel 10, with connection terminals of respective scan electrodes Y1 through Yn interposed therebetween. Thus, the scan electrode driving circuits 41*a* are directly electrically connected to the connection terminals of the scan electrodes Y1 through Yn.

In place of the light-emitting elements 42 described with reference to the first embodiment, four each light-emitting elements 42*a* are provided on the light emission driving circuit substrates 43 at both upper and lower ends of the liquid crystal panel 10.

Figure 9:
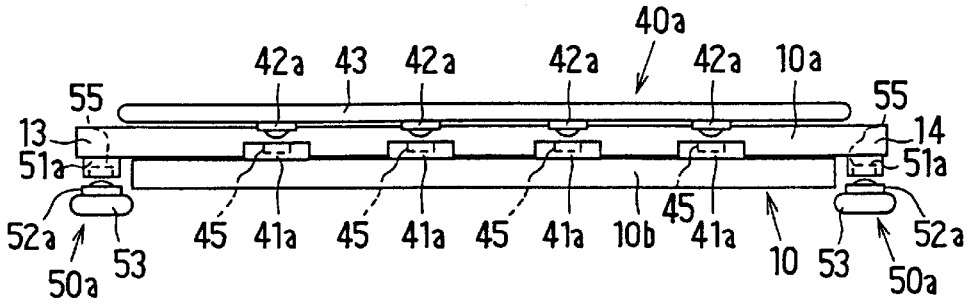
FIG. 9 is a bottom view of the liquid crystal panel.

The light emission driving circuit substrates 43 in the second embodiment are different from those in the first embodiment in that, as shown in FIG. 9, the light-emitting elements 42*a* are in a face-to-face relationship, and in parallel, with the upper and lower ends 11, 12 of the common electrode substrate 10*b* to directly face the respective scan electrode driving circuits 41*a*.

As shown in FIGS. 8 through 11, each of the scan electrode driving systems 40*a* includes the above-described light-receiving elements 45 positioned to receive light from the respective light-emitting elements 42*a* at light-receiving portions thereof.

The signal electrode driving systems 50*a* include light emission driving circuit substrates 53 and light emission driving circuits 53*a* as described with reference to the first embodiment, as well as signal electrode driving circuits 51*a*, light-emitting elements 52*a* and light-receiving elements 55 corresponding to the signal electrode driving circuits 51, the light-emitting elements 52 and the light-receiving elements 54, respectively.

Figure 10:
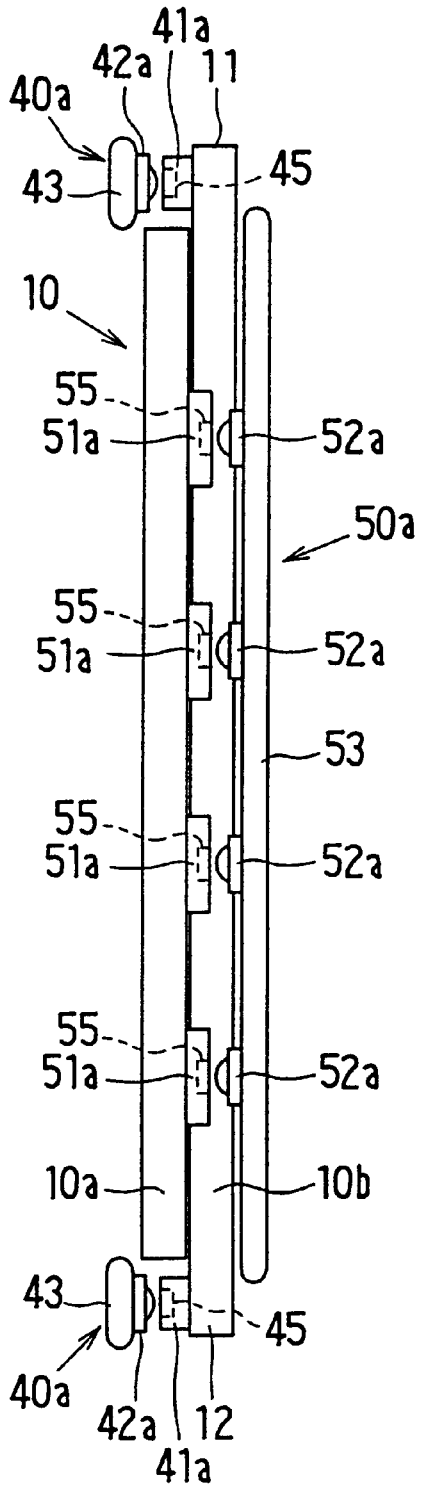
FIG. 10 is a right side view of the liquid crystal panel.
Figure 11:
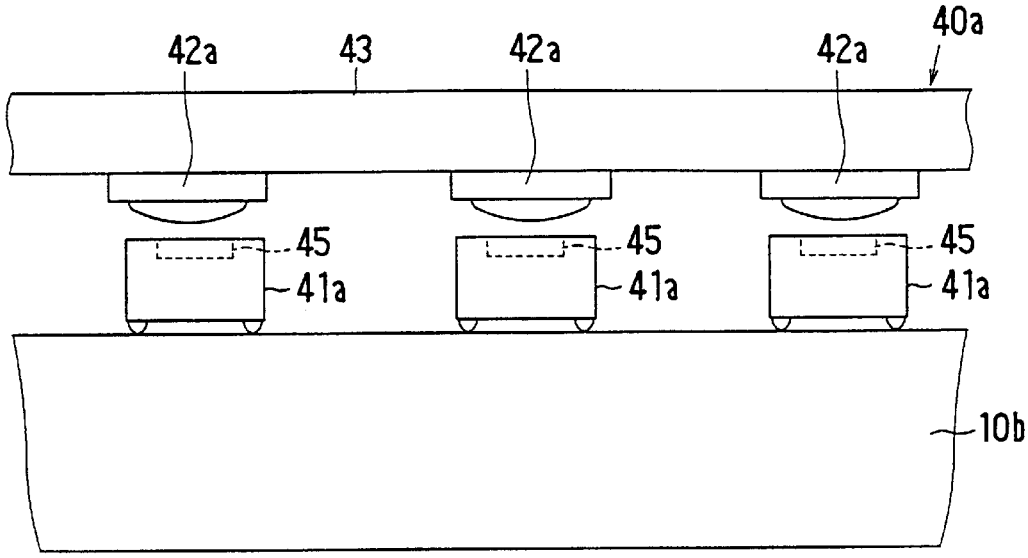
FIG. 11 is a partial enlarged bottom view of the liquid crystal panel in FIG. 8.

As shown in FIGS. 9 and 10, instead of the signal electrode driving circuits 51 of the first embodiment, four each signal electrode driving circuits 51*a* are disposed on both of left and right ends 13, 14 of a CF electrode substrate 10*a* of the liquid crystal panel 10, with connection terminals of respective signal electrodes X1 through Xn interposed therebetween. Thus, the signal electrode driving circuits 51*a* are directly electrically connected to the connection terminals of the signal electrodes X1 through Xn.

In place of the light-emitting elements 52 described with reference to the first embodiment, four each light-emitting elements 52*a* are provided on the light emission driving circuit substrates 53 at both of left and right ends of the liquid crystal panel 10.

The light emission driving circuit substrates 53 in the second embodiment are different from those in the first embodiment in that, as shown in FIG. 10, the light-emitting elements 52*a* are in a face-to-face relationship, and in parallel, with the left and right ends 13, 14 of the CF electrode substrate 10*a* to directly face the respective signal electrode driving circuits 51*a*.

Each of the signal electrode driving systems 50*a* includes the above-described light-receiving elements 55 positioned to receive light from the respective light-emitting elements 52*a*.

In the second embodiment, however, if it is assumed that the four light-emitting elements 42*a* at the lower end 12 of the common electrode substrate 10*b* are referred to as "first through fourth lower light-emitting elements 42*a*" beginning with the leftmost light-emitting element 42*a* as viewed in FIG. 9, each of the first and third lower light-emitting elements 42*a* is a semiconductor laser oscillated in a visible region having a wavelength of 0.65 $\mu$m (AlGaInP type), and each of the second and fourth lower light-emitting elements 42*a* is a semiconductor laser oscillated in a near infrared region having a wavelength of 1.6 $\mu$m (InAsP type).

Each of the two light-receiving elements 45 facing the first and third lower light-emitting elements 42*a* is a CdSe element that exhibits high light-receiving sensitivity in the visible light region. Each of the two light-receiving elements 45 facing the second and fourth lower light-emitting elements 42*a* is a PbSe element that exhibits high light-receiving sensitivity in an infrared region.

If the four light-emitting elements 42*a* located at the upper end 11 of the common electrode substrate 10*b* in association with the first through fourth lower light-emitting elements 42*a* are referred to as first through fourth upper light-emitting elements 42*a*, then, each of the first and third upper light-emitting elements 42*a* is a semiconductor laser oscillated in a visible region as described above, while each of the second and fourth upper light-emitting elements 42*a* is a semiconductor laser oscillated in a near infrared region as described above.

Each of the two light-receiving elements 45 facing the first and third upper light-emitting elements 42*a* is a CdSe element as described above. Each of the two light-receiving elements 45 facing the second and fourth upper light-emitting elements 42*a* is a PbSe element as described above.

If the four light-emitting elements 52A at the right end 14 of the CF electrode substrate 10*a* are referred to as first through fourth right-side light-emitting elements 52*a* starting with the uppermost light-emitting element 52*a* as viewed in FIG. 10, then, each of the first and third right-side light-emitting elements 52*a* is a semiconductor laser oscillated in a visible region as described above, and each of the second and fourth right-side light-emitting elements 52*a* is a semiconductor laser oscillated in a near infrared region as described above.

Each of the two light-receiving elements 55 facing the first and third right-side light-emitting elements 52*a* is a CdSe element as described above. Each of the two light-receiving elements 55 facing the second and fourth right-side light-emitting elements 52A is a PbSe element as described above.

If the four light-emitting elements 52A located at the left end 13 of the CF electrode substrate 10*a* in association with the first through fourth right-side light-emitting elements 52A are referred to as first through fourth left-side light-emitting elements 52*a*, then, each of the first and third left-side light-emitting elements 52*a* is a semiconductor laser oscillated in a visible region as described above, and each of the second and fourth left-side light-emitting elements 52*a* is a semiconductor laser oscillated in a near infrared region as described above.

Each of the two light-receiving elements 55 facing the first and third left-side light-emitting elements 52*a* is a CdSe element as described above. Each of the two light-receiving elements 55 facing the second and fourth left-side light-emitting elements 52A is a PbSe element as described above. The configuration of the present embodiment is otherwise the same as the first embodiment.

In the second embodiment when the synchronization circuit 61 generates vertical and horizontal synchronization signals as in the first embodiment, the light emission driving circuits 43*a* in the scan electrode driving systems 40*a* drive the respective light-emitting elements 42*a*, and the light-emitting elements 42*a* generate optical synchronization signals. Subsequently, the light-receiving elements 45 receive the optical synchronization signals directly from the respective light-emitting elements 42*a* to generate light-reception signals, and the scan electrode driving circuits 41*a* scan the scan electrodes X1 through Xn on a line sequential basis in accordance with the light-reception signals from the light-receiving elements 45.

Similarly to the first embodiment, the memory circuit 62 of the signal output circuit 60 stores image signals from the image signal source 70 on a line by line basis, and inputs the stored image data to the light emission driving circuits 53*a* as light emission driving signals in synchronism with the vertical and horizontal synchronization signals from the synchronization circuit 61.

As a result, the light emission driving circuits 53*a* drive the light-emitting elements 52*a* for emission of light based on the light emission driving signals. At this time, the beams from the light-emitting elements 52*a* are subjected to pulse code modulation based on image data in the light emission driving signals from the light emission driving circuits 53*a*.

In response to the reception of the modulated beams from the light-emitting elements 52*a* at the light-receiving elements 55, the signal electrode driving circuits 51*a* sequentially output optical data signals corresponding to the modulated beams to the signal electrodes X1 through Xm on a scan line by scan line basis in synchronism with the optical synchronization signals to the scan electrodes Y1 through Yn, thereby outputting image data for one screen.

When the scan electrode driving systems 40*a* drive the scan electrodes Y1 through Yn for line sequential scanning and the signal electrode driving circuits 50*a* output image data to the signal electrodes X1 through Xm, the liquid crystal panel 10 shows a matrix display.

As described above, according to the second embodiment, transmission of synchronization signals from the synchronization circuit 61 to the scan electrode driving circuits 41*a* is carried out through optical communication utilizing the plurality of associated pairs of light-emitting elements 42*a* and light-receiving elements 45, whereas the transmission of image data from the memory circuit 62 to the signal electrode driving circuits 51*a* is carried out through optical communication utilizing the plurality of associated pairs of light-emitting elements 52*a* and light-receiving elements 55. As a result, it is possible to achieve the same effect as that of the first embodiment.

In this second embodiment, one of two adjacent pairs of light emitting element 42*a* and light-receiving element 45 facing each other in the scan electrode driving system 40*a* is a combination of a semiconductor lasers oscillated in a visible region and a CdSe element, as described above, whereas the other pair is a combination of a semiconductor laser oscillated in an infrared region and a PbSe element, as described above.

In this case, as the wavelength of an optical synchronization signal as visible light from the semiconductor laser oscillated in a visible range is completely different from the wavelength of an optical synchronization signal as infrared light from the adjacent semiconductor laser oscillated in an infrared region, there is no mutual interference between the two optical synchronization signals.

Further, the CdSe element has high light-receiving sensitivity to visible light, and the PdSe element has high light-receiving sensitivity to infrared light. Therefore, the CdSe element and PbSe element differ from each other in terms of wavelength dependence.

Therefore, even when both a CdSe element and a PbSe element adjacent to each other respectively receive optical synchronization signals from a semiconductor laser oscillated in a visible region and a semiconductor laser oscillated in an infrared region, light-reception signals from the CdSe element and PbSe element are not affected by interference.

As described above, one of two adjacent pairs of light emitting element 52*a* and light-receiving element 55 facing each other in the signal electrode driving system 50*a* is a combination of a semiconductor laser oscillated in a visible region and a CdSe element, as described above, whereas the other pair is a combination of a semiconductor laser oscillated in an infrared region and a PbSe element, as described above.

Therefore, no mutual interference occurs between two optical synchronization signals from a semiconductor laser oscillated in a visible region and a semiconductor laser oscillated in an infrared region which are adjacent to each other as in the scan electrode driving system 40*a*. Further, even when both of a CdSe element and a PbSe element adjacent to each other receive optical synchronization signals from a semiconductor laser oscillated in a visible region and a semiconductor laser oscillated in an infrared region, similarly, light-reception signals from the CdSe element and PbSe element are not affected by interference.

It is therefore possible to significantly increase the number in unit area of transmission paths consisting of combinations of light-emitting and light-receiving elements from that available when light-emitting elements emitting light having a single wavelength (emission color) are used as the light emitting elements 42*a* and 52*a*. This allows a liquid crystal display of this type to provide a display utilizing optical communication of a large capacity, such as large screen liquid crystal panels.

Since each pair of associated light-emitting and light receiving elements in the scan electrode driving system 40*a*, and each pair of associated light-emitting and light-receiving elements in the signal electrode driving system 50*a*, directly face each other as described above, it is possible to further reduce the distance between each pair of light-emitting and light-receiving elements.

In this second embodiment, as described above, the scan electrode driving circuits 41*a* are disposed along with the associated light-receiving elements 44 on both of upper and lower ends 11, 12 of the glass substrate of the common electrode substrate 10*b*, with the connection terminals of the respective scan electrodes Y1 through Yn interposed therebetween. Thus, the circuits are directly electrically connected to the connection terminals of the scan electrodes Y1 through Yn at connection terminals thereof. Also, the signal electrode driving circuits 51*a* are disposed along with the associated light-receiving elements 55 on both of left and right ends of the glass substrate of the CF electrode substrate 10*a*, with the connection terminals of the respective signal electrodes X1 through Xm interposed therebetween. Thus, the circuits are directly electrically connected to the connection terminals of the signal electrodes X1 through Xm at connection terminals thereof.

This significantly facilitates the electrical connection of the scan electrode driving circuits 41*a* to the scan electrodes Y1 through Yn and the electrical connection of the signal electrode driving circuits 51*a* to the signal electrodes X1 through Xm similarly to the first embodiment described above. Such an effect becomes more significant as the screen of the liquid crystal panel 10 becomes larger.

Figure 13:
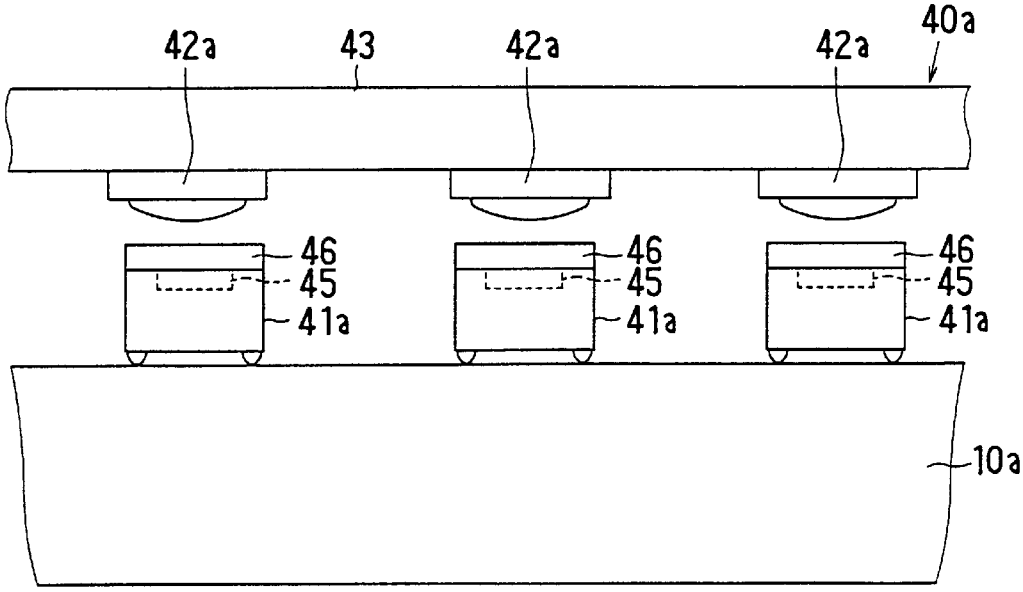
FIG. 13 is a partial enlarged bottom view of a liquid crystal panel representing a modification of the second embodiment.
Figure 12:
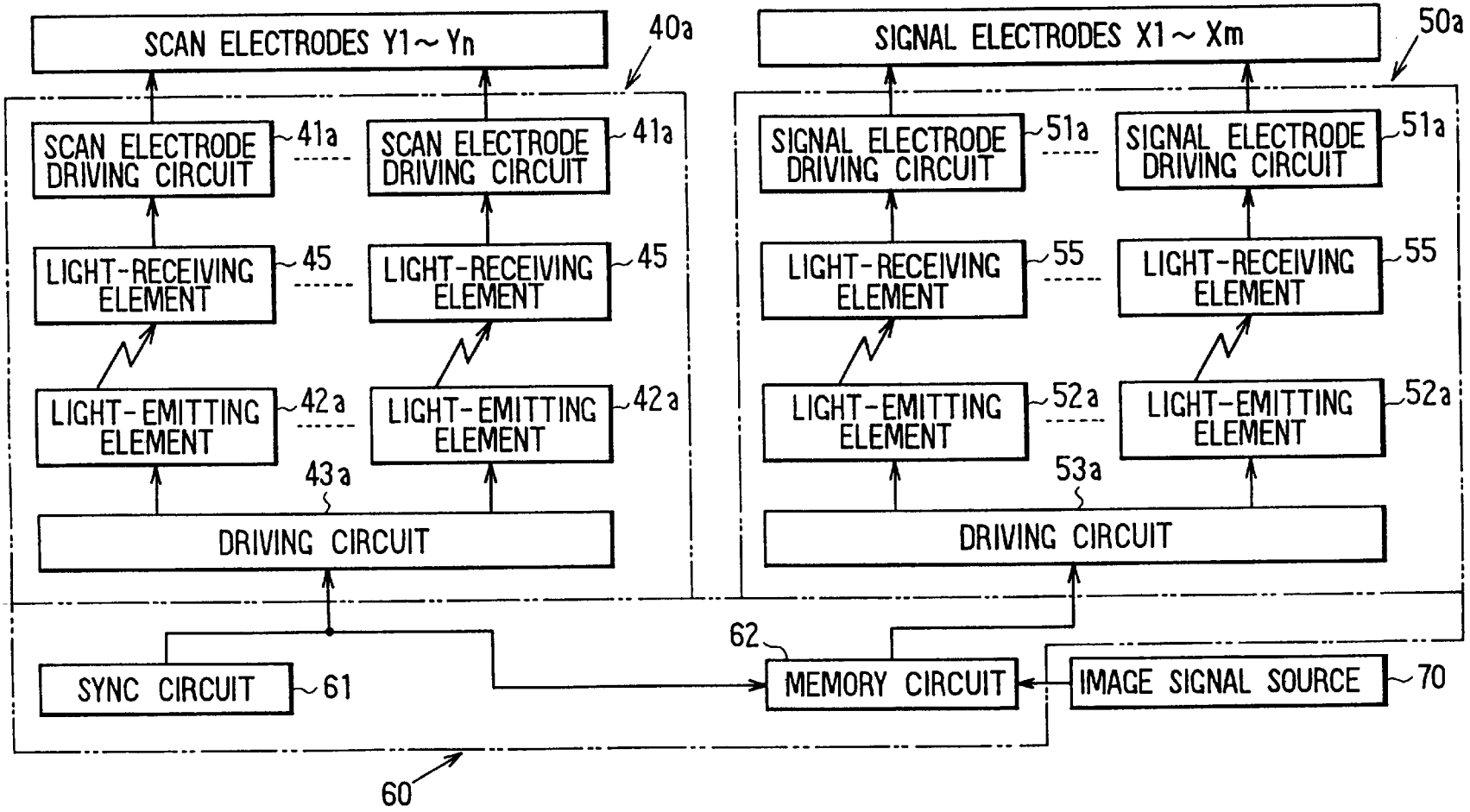
FIG. 12 is a detailed block diagram of the second embodiment.

FIG. 13 shows a modification of the second embodiment. As shown in FIG. 13, an optical filter 46 is applied to the end face of each scan electrode driving circuit 41*a* described in the second embodiment where the light-receiving element 45 is located such that it faces the associated light-emitting element 41*a*. Further, an optical filter is applied to the end face of each signal electrode driving circuit 51*a* described in the second embodiment where the light-receiving element 55 is located such that it faces the associated light-emitting element 51*a*.

The optical filter 46 applied to each of the first upper and lower light-receiving elements 45 and the third upper and lower light-receiving elements 45 described in the second embodiment is an optical filter in the bluish-green visible wavelength region that transmits light having a wavelength of 0.5 $\mu$m or less. A similar optical filter is applied to each of the first right and left light-receiving elements 55 and the third right and left light-receiving elements 55 described in the second embodiment.

The optical filter 46 applied to each of the second upper and lower light-receiving elements 45 and the fourth upper and lower light-receiving elements 45 described in the second embodiment is an optical filter in the red wavelength region that transmits light having a wavelength of 0.7 $\mu$m or more. A similar optical filter is applied to each of the second right and left light-receiving elements 55 and the fourth right and left light-receiving elements 55 described in the second embodiment.

The first upper and lower light-emitting elements 42*a* and the third upper and lower light-emitting elements 42*a* described in the second embodiment are preferably blue light-emitting diodes having a wavelength of 0.45 $\mu$m in the present modification instead of the above-described semiconductor lasers oscillated in a visible region, as are the first right and left light-emitting elements 52*a* and third right and left light-emitting elements 52*a*.

The second upper and lower light-emitting elements 42*a* and the fourth upper and lower light-emitting elements 42*a* described in the second embodiment are red light-emitting diodes having a wavelength of 0.7 $\mu$m in the present modification instead of the above-described semiconductor lasers oscillated in an infrared region, as are the second right and left light-emitting elements 52*a* and the fourth right and left light-emitting elements 52*a*.

All of the light-receiving elements 45 and 55 described in the second embodiment are replaced by PIN diodes in the present modification unlike the second embodiment. The configuration is otherwise the same as that in the second embodiment.

In the above modified second embodiment, one of two adjacent pairs of light emitting element 42*a* and optical filter 46 facing each other is a combination of a blue light-emitting diode and a bluish green optical filter, whereas the other pair is a combination of a red light-emitting diode and a red optical filter.

In this case, since the wavelength of an optical synchronization signal as blue light from the blue light-emitting diode differs from the wavelength of an optical synchronization signal as red light from the adjacent red light-emitting diode, there is no mutual interference between the two optical synchronization signals.

Further, the bluish green optical filter transmits only light having a wavelength of 0.5 $\mu$m or less, and the red optical filter transmits only light having a wavelength of 0.7 $\mu$m or more. Therefore, the combination of a blue light-emitting diode and a bluish green optical filter, and the combination of a red light-emitting diode and a red optical filter, are completely different from each other in terms of wavelength dependence.

Therefore, even when PIN photodiodes adjacent each other receive optical synchronization signals from blue and red light-emitting diodes in a face-to-face relationship through respective optical filters, light reception signals from the PIN photodiodes are not affected by interference.

The above description equally applies to the signal electrode driving systems 50*a*.

Figure 14:
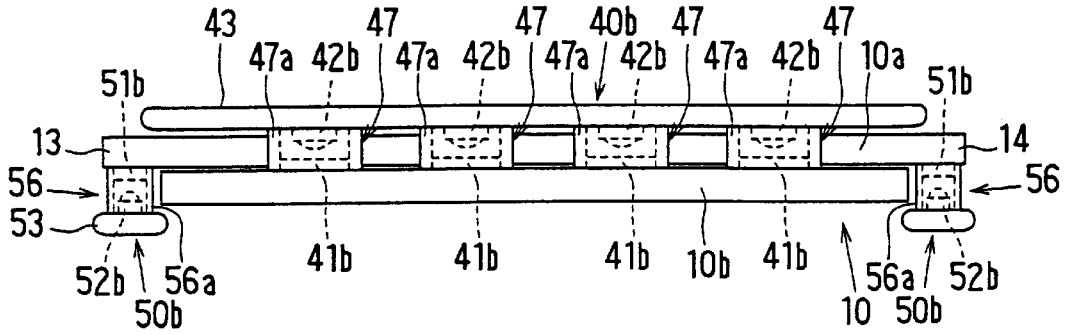
FIG. 14 is a bottom view of a liquid crystal panel of a third embodiment of a liquid crystal display according to the present invention.
Figure 15:
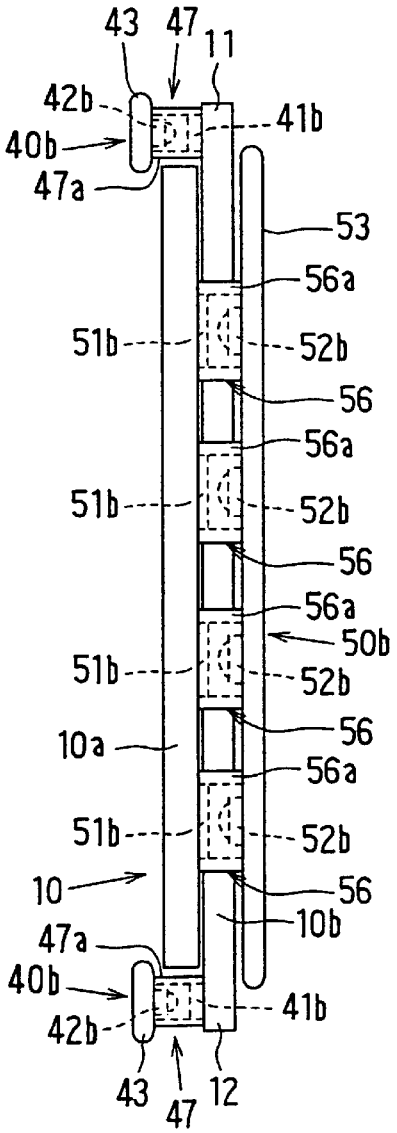
FIG. 15 is a right side view of the liquid crystal panel.
Figure 16:
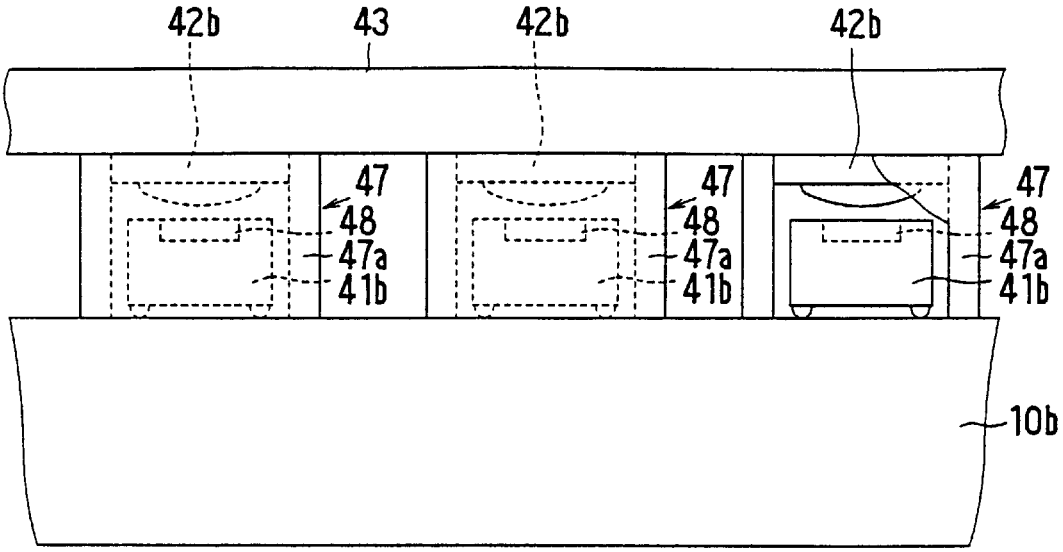
FIG. 16 is a partial enlarged bottom view of the liquid crystal panel.

FIGS. 14 through 16 show the third embodiment of the invention. In the third embodiment, as shown in FIGS. 14 and 15, scan electrode driving systems 40*b* and signal electrode driving systems 50*b* are utilized in place of the scan electrode driving systems 40*a* and signal electrode driving systems 50*a* described in the second embodiment.

The scan electrode driving systems 40*b* have a configuration formed by replacing the scan electrode driving circuits 41*a* and light-emitting elements 42*a* in the scan electrode driving systems 40*a* described in the second embodiment with respective scan-side transmission paths 47.

As apparent from FIGS. 14 and 15, instead of the scan electrode driving circuits 41*a* and light-emitting elements 42*a* associated with each other, four scan-side transmission paths 47 are interposed between an upper end 11 of a common electrode substrate 10*b* of a liquid crystal panel 10 and light emission driving circuit substrates 43 in a face-to-face relationship therewith. Also, four other scan-side transmission paths 47 are interposed between a lower end 12 of the common electrode substrate 10*b* and light emission driving circuit substrates 43 in a face-to-face relationship therewith.

As shown in FIGS. 14 through 16, each of the scan-side transmission paths 47 includes a light blocking cylinder 47*a*. The light blocking cylinders 47*a* are provided between the upper end 11 of the common electrode substrate 10*b* and the light emission driving circuit substrates 43 facing the same and between the lower end 12 of the common electrode substrate 10*b* and the light emission driving circuit substrates 43 facing the same such that the cylinder axes are normal to the surface of the common electrode substrate 10*b*. The interval between the outer walls of two light blocking cylinders 47*a* which are adjacent and parallel to each other is at least, for example, 5 mm.

Each of the scan-side transmission paths 47 includes a scan electrode driving circuit 41*b* and a light-emitting element 42*b* facing each other in place of the scan electrode driving circuit 41*a* and light-emitting element 42*a* facing each other described in the second embodiment. In place of the scan electrode driving circuits 41*a* described in the second embodiment, the scan electrode driving circuits 41*b* are disposed on both of the upper and lower ends 11, 12 of the common electrode substrate 10*b* with connection terminals of respective scan electrodes Y1 through Yn interposed therebetween. Thus, the scan electrode driving circuits 41*b* are directly electrically connected to the connection terminals of the scan electrodes Y1 through Yn similarly to the scan electrode driving circuits in the second embodiment.

The scan electrode driving circuits 41*b* include light-receiving elements 48 in a face-to-face relationship with light-emitting elements 42*b* associated therewith (see FIG. 16). In place of the light-emitting elements 42*a* described with reference to the second embodiment, the light-emitting elements 42*b* are provided on the light emission driving circuit substrates 43. The interval between surfaces of a light-emitting element 42*a* and a light-receiving element 48 facing each other is, for example, about 4 mm.

The signal electrode driving systems 50*b* have a configuration formed by replacing the signal electrode driving circuits 51*a* and light-emitting elements 52*a* in the signal electrode driving systems 50*a* described in the second embodiment with signal-side transmission paths 56.

As apparent from FIGS. 14 and 15, instead of the signal electrode driving circuits 51*a* and light-emitting elements 52*a* associated with each other, four signal-side transmission paths 56 are interposed between a left end 13 of the common electrode substrate 10*b* of the liquid crystal panel 10 and light emission driving circuit substrates 53 in a face-to-face relationship therewith. Four other signal-side transmission paths 56 are interposed between a right end 14 of the common electrode substrate 10*b* and light emission driving circuit substrates 53 in a face-to-face relationship therewith.

Each of the signal-side transmission paths 56 includes a light blocking cylinder 56*a*. The light blocking cylinders 56*a* are provided between the left end 13 of the common electrode substrate 10*b* and the light emission driving circuit substrates 53 facing the same, and between the right end 14 of the common electrode substrate 10*b* and the light emission driving circuit substrates 53 facing the same such that the axes of the cylinders are normal to the surface of the common electrode substrate 10*b*.

Each of the signal-side transmission paths 56 includes a signal electrode driving circuit 51*b* and a light-emitting element 52*b* facing each other in place of the signal electrode driving circuit 51*a* and light-emitting element 52*a* facing each other described in the second embodiment. The signal electrode driving circuits 51*b* are disposed on both of the left and right ends 13, 14 of the common electrode substrate 10*b*, with connection terminals of respective signal electrodes X1 through Xm interposed therebetween. Thus, the signal electrode driving circuits 51*b* are directly electrically connected to the connection terminals of the signal electrodes X1 through Xm, as are the signal electrode driving circuits described in the second embodiment.

The signal electrode driving circuits 51*b* include light-receiving elements in a face-to-face relationship with light-emitting elements 52*b* associated therewith. In place of the light-emitting elements 52*a* described with reference to the second embodiment, the light-emitting elements 52*b* are disposed on the light emission driving circuit substrates 53.

In this third embodiment, both of the light-emitting elements 42*b* and 52*b* are semiconductor lasers oscillated in a near infrared region having a wavelength of 1.6 about $\mu$m, and both of the light-receiving elements 48 of the scan electrode driving circuits 41*b* and the light-receiving elements of the signal electrode driving circuits 51*b* are PIN photodiodes. The configuration is otherwise the same as that of the second embodiment.

In this third embodiment, each of the scan-side transmission paths 47 in the scan electrode driving systems 40*b* is configured by containing a light-emitting element 42*b* and a scan electrode driving circuit 41B facing each other in a light blocking cylinder 47*a*, whereas each of the signal-side transmission paths 56 in the signal electrode driving systems 50*b* is configured by containing a light-emitting element 52*b* and a signal electrode driving circuit 51*b* facing each other in a light blocking cylinder 56*a*.

As a result, even when signals are optically transmitted in substantially the same manner as in the second embodiment between the light-emitting and light receiving elements facing each other within the light blocking cylinders 47*a* and 56*a* in the scan-side transmission paths 47 and signal-side transmission paths 56, the light blocking cylinders 47*a* and 56*a* prevent such signals from leaking to the outside. Thus, no effect of optical interference occurs between adjacent scan-side transmission paths or signal-side transmission paths. This makes it possible to achieve the same effect as that of the second embodiment.

According to the third embodiment, the interval between the outer walls of two adjacent light blocking cylinders is at least 5 mm as described above. In addition, each of the light-emitting elements is a semiconductor laser oscillated in a near infrared region having a wavelength of 1.6 $\mu$m as described above. It is therefore possible to maintain preferable directivity of an optical signal from each light-emitting element to the light-receiving element facing the same even when the interval between the surfaces of the light-emitting and light-receiving elements in a face-to-face relationship is about 4 mm. This allows preferable optical signal transmission between light-emitting and light-receiving elements facing each other. For this reason, each of the light-emitting elements may be a semiconductor laser having directivity. Other operations and effects are the same as those in the second embodiment.

Figure 17:
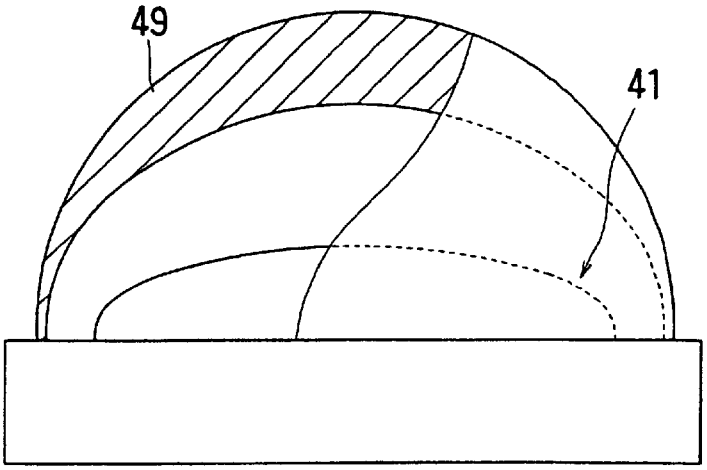
FIG. 17 is a partially cut-away enlarged view of a light-emitting element representing a modification of the second embodiment.

FIG. 17 shows a modification of the third embodiment having a configuration in which the light-emitting elements 42*b* in the scan-side transmission paths 47 described in the third embodiments are replaced with convex lenses 49 provided on the light-emitting surfaces of the light-emitting elements 41 described in the first embodiment, as are the light-emitting elements in the signal-side transmission paths 56. The configuration is otherwise the same as that of the third embodiment.

In the present modification, such a convex lens 49 enhances the directivity of the light-emitting element in each of the scan-side transmission paths 47 toward the light-receiving element 48 facing the same and enhances the directivity of the light-emitting element in each of the signal-side transmission paths 56 toward the light-receiving element 48 of the signal electrode driving circuit 51*b* facing the same.

As a result, this modification also makes it possible to achieve the same effect as that achieved with the scan-side transmission paths 47 and signal-side transmission paths described in the third embodiment.

Figure 18:
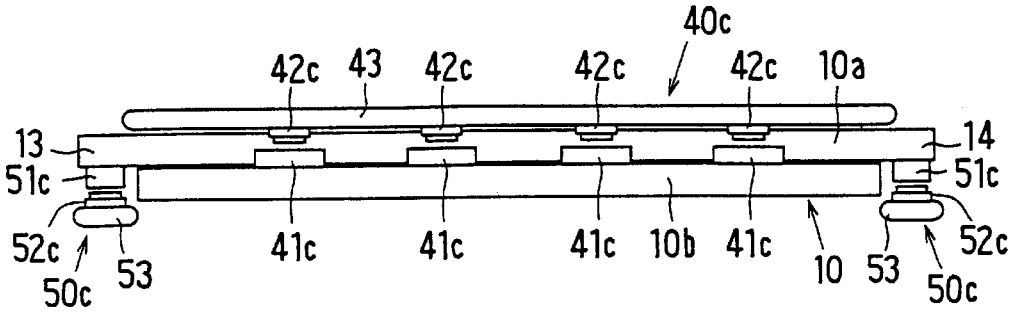
FIG. 18 is a bottom view of a liquid crystal panel of a fourth embodiment of a liquid crystal display according to the present invention.
Figure 19:
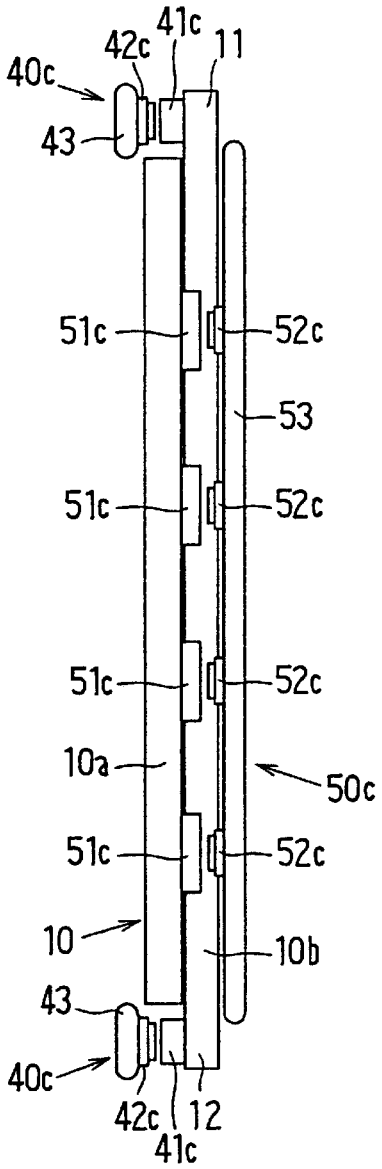
FIG. 19 is a right side view of the liquid crystal panel.
Figure 20:
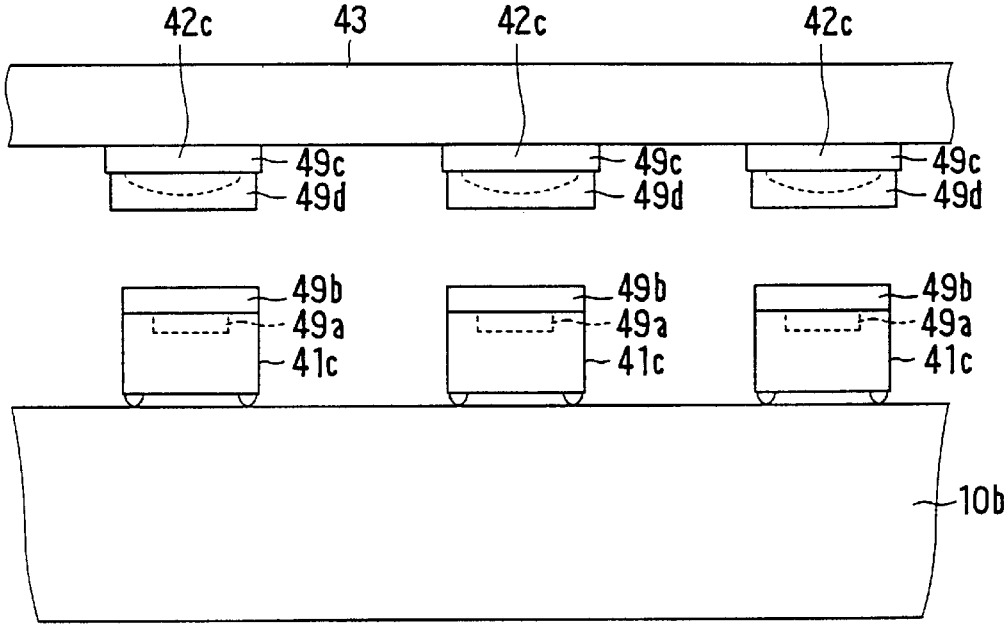
FIG. 20 is a partial enlarged bottom view of the liquid crystal panel.

FIGS. 18 through 20 show the fourth embodiment of the invention. In the fourth embodiment, as shown in FIGS. 18 and 19, scan electrode driving systems 40*c* and signal electrode driving systems 50*c* are utilized in place of the scan electrode driving systems 40*a* and signal electrode driving systems 50*a* described in the second embodiment.

In the scan electrode driving systems 40*c*, the scan electrode driving circuits 41*a* and light-emitting elements 42*a* in the scan electrode driving systems 40*a* described in the second embodiment are replaced with scan electrode driving circuits 41*c* and light-emitting elements 42*c*, respectively. The signal electrode driving systems 50*c* have a configuration formed by replacing the signal electrode driving circuits 51*a* and light-emitting elements 52*a* in the signal electrode driving systems 50*a* described in the second embodiment with signal electrode driving circuits 51*c* and light-emitting elements 52*c*, respectively.

As apparent from FIGS. 18 and 19, instead of the scan electrode driving circuits 41*a* described in the second embodiment, four each scan electrode driving circuits 41*c* are disposed on both of upper and lower ends 11, 12 of the common electrode substrate 10*b* of the liquid crystal panel 10, with the connection terminals of scan electrodes Y1 through Yn interposed therebetween. Thus, the scan electrode driving circuits 41*c* are directly electrically connected to the connection terminals of the respective scan electrodes Y1 through Yn.

As shown in FIG. 20, each of the scan electrode driving circuits 41*c* includes a light receiving element 49*a* and a polarizing plate 49*b*. The light-receiving elements 49*a* are positioned to receive light from the light-emitting portions of the light-emitting elements 42*c* associated therewith through the polarizing plates 49*b* at light-receiving portions thereof.

The polarizing plates 49*b* are applied to the scan electrode driving circuits 41*c* to cover the light-receiving elements 49*a* thereof (see FIG. 20).

Four each light-emitting elements 42*c* are disposed on light emission driving circuit substrates 43 of the liquid crystal panel 10 at both of upper and lower ends thereof in place of the light-emitting elements 42*a* described in the second embodiment.

Each of the light-emitting elements 42*c* is formed by applying a polarizing plate 49*d* on the light-emitting surface of a red light emitting diode 49*c* having a wavelength of about 0.7 $\mu$m.

The polarization axes of polarizing plates 49*b* and 49*d* in a face-to-face relationship coincide with each other. If the four light-emitting elements 42C located at the lower end 12 of the common electrode substrate 10*b* are referred to as first through fourth lower light-emitting elements 42*c* in the order starting with the leftmost light-emitting element 42C as viewed in FIG. 18, then the polarization axes of the polarizing plates 49*d* of the first and third lower light-emitting elements 42*c* are orthogonal to the polarization axes of the polarizing plates 49*d* of the second and fourth lower light-emitting elements 42*c*.

If the light-emitting elements 42*c* located at the upper end 11 of the common electrode substrate 10*b* in association with the first through fourth lower light-emitting elements 42C are referred to as first through fourth upper light-emitting elements 42*c*, then the polarization axes of the polarizing plates of the first and third upper light-emitting elements 42*c* are orthogonal to the polarization axes of the polarizing plates of the second and fourth upper light-emitting elements 42*c*.

As apparent from FIGS. 18 and 19, instead of the signal electrode driving circuits 51*b* described in the second embodiment, four each signal electrode driving circuits 51*c* are disposed on both of left and right ends 13 and 14 of a CF electrode substrate 10*a* of the liquid crystal panel 10, with the connection terminals of signal electrodes X1 through Xm interposed therebetween. Thus, the signal electrode driving circuits 51*c* are directly electrically connected to the connection terminals of the respective signal electrodes X1 through Xm.

Each of the signal electrode driving circuits 51*c* includes a light-receiving element and a polarizing plate applied thereto so as to cover the light-receiving element.

The light-receiving elements of the signal electrode driving circuits 51*c* are positioned to receive light from the light-emitting elements 52*c* associated therewith through the polarizing plates covering the same.

Four each light-emitting elements 52*c* are disposed on light emission driving circuit substrates 43 of the liquid crystal panel 10 at both of upper and lower ends thereof in place of the light-emitting elements 52*a* described in the second embodiment.

Each of the light-emitting elements 52*c* is formed by applying a polarizing plate on the light-emitting surface of a red light emitting diode having a wavelength of about 0.7 μm. The polarization axes of the polarizing plates of a light-emitting element 52*c* and a signal electrode driving circuit 51*c* in a face-to-face relationship coincide with each other.

If the four light-emitting elements 52*c* located at a right end 14 of the common electrode substrate 10*b* are referred to as first through fourth right-side light-emitting elements 52*c* starting with the uppermost light-emitting element 52*c* as viewed in FIG. 18, then the polarization axes of the polarizing plates of the first and third right-side light-emitting elements 52*c* are orthogonal to the polarization axes of the polarizing plates of the second and fourth right-side light-emitting elements 52*c*.

If the light-emitting elements 52*c* located at a left end 13 of the common electrode substrate 10*b* in association with the first through fourth right-side light-emitting elements 52*c* are referred to as first through fourth left-side light-emitting elements 52*c*, then the polarization axes of the polarizing plates of the first and third left-side light-emitting elements 52*c* are orthogonal to the polarization axes of the polarizing plates of the second and fourth left-side light-emitting elements 52*c*.

PIN photodiodes are used as the light-receiving elements 49*a* and the light-receiving elements of the signal electrode driving circuits 51*c*. The configuration is otherwise the same as that of the second embodiment.

In the fourth embodiment, the polarization axes of the polarizing plates of scan electrode driving circuits 41*c* and light-emitting elements 42*c* associated with each other in the scan electrode driving systems 40*c* are orthogonal to the polarization axes of the polarizing plates of scan electrode driving circuits 41*c* and light-emitting elements 42*c* associated with each other, in positions adjacent to the scan electrode driving circuits 41*c* and light-emitting elements 42*c*.

Even when optical signal communication is carried out between an associated light-receiving element of a scan electrode driving circuit 41*c* and a light-emitting element 42*c* through the respective polarizing plates, no interference occurs on the optical signal communication between the light-receiving element of the scan electrode driving circuit 41*c* and the light-emitting element 42*c* positioned adjacent to each other, as the polarization axes are orthogonal to each other as described above.

The polarization axes of the polarizing plates of signal electrode driving circuits 51*c* and light-emitting elements 52*c* associated with each other in the signal electrode driving systems 50*c* are orthogonal to the polarization axes of the polarizing plates of signal electrode driving circuits 51*c* and light-emitting elements 52*c* associated with each other in positions adjacent to the signal electrode driving circuits 51*c* and light-emitting elements 52*c*.

Therefore, even when optical signal communication is carried out between an associated light-receiving element of a signal electrode driving circuit 51*c* and a light-emitting element 52*c* through the respective polarizing plates, no interference occurs because of the polarization axes orthogonal to each other as described above.

As a result, the fourth embodiment can provide the same effect as that of the second embodiment. The other effects are the same as those of the second embodiment.

Figure 21:
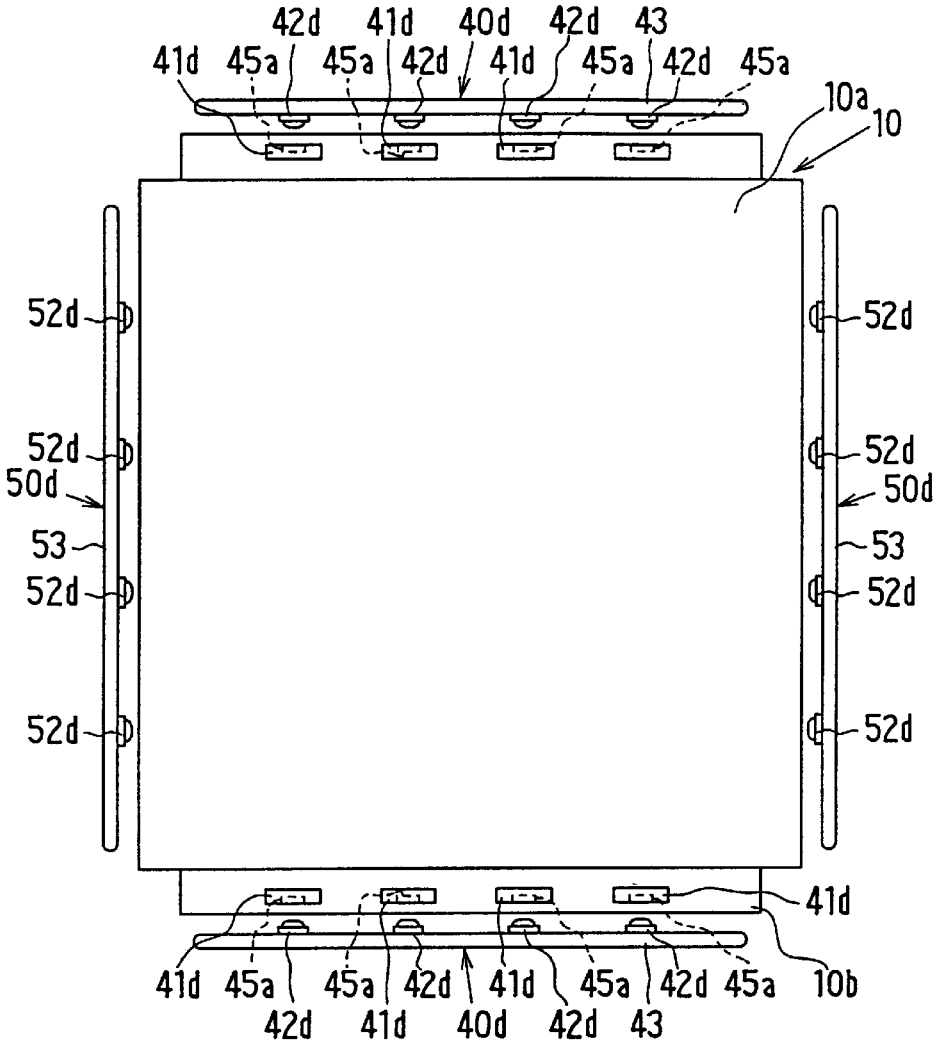
FIG. 21 is a plan view of a liquid crystal panel of a fifth embodiment of a liquid crystal display according to the present invention.
Figure 22:
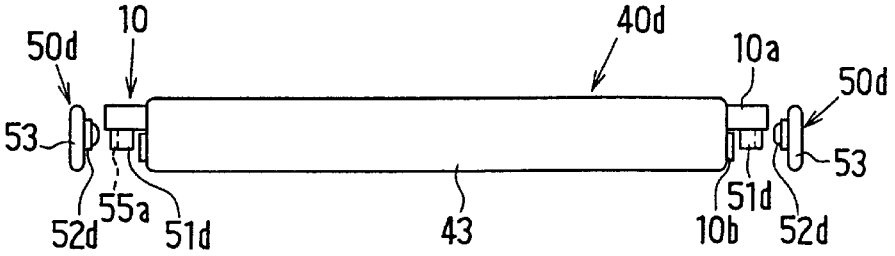
FIG. 22 is a bottom view of the liquid crystal panel of the fifth embodiment.
Figure 23:
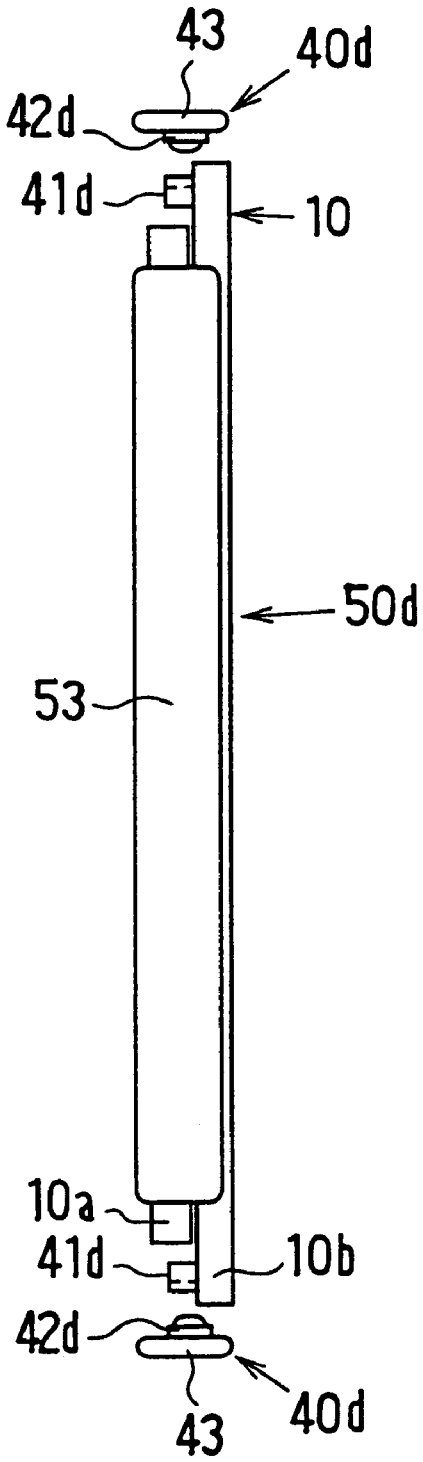
FIG. 23 is a right side view of the liquid crystal panel.

FIGS. 21 through 23 show the fifth embodiment of the invention. In the fifth embodiment, as shown in FIGS. 21 through 23, scan electrode driving systems 40*d* and signal electrode driving systems 50*d* are utilized in place of the scan electrode driving systems 40*a* and signal electrode driving systems 50*a* described in the second embodiment.

The scan electrode driving systems 40*d* have a configuration formed by replacing the scan electrode driving circuits 41*a* and light-emitting elements 42*a* in the scan electrode driving systems 40*a* described in the second embodiment with scan electrode driving circuits 41*d* and light-emitting elements 42*d*, respectively. The signal electrode driving systems 50*d* have a configuration formed by replacing the signal electrode driving circuits 51*a* and light-emitting elements 52*a* described in the second embodiment with signal electrode driving circuits 51*d* and light-emitting elements 52*d*, respectively.

The fifth embodiment differs from the second embodiment in that, as shown in FIG. 21, light emission driving circuit substrates 43 are disposed along both upper and lower ends 11, 12 of a common electrode substrate 10*b* such that the substrates are positioned perpendicularly to the plane of the upper and lower ends 11, 12. Thus, the light emission driving circuit substrates 43 face the respective scan electrode driving circuits 41*d* in the lateral direction thereof at the light-emitting elements 42*d* thereof along the surface of the upper and lower ends 11, 12 of the common electrode substrate 10*b* (side surfaces of the connection terminal portions).

The fifth embodiment also differs from the second embodiment in that, as shown in FIG. 21, light emission driving circuit substrates 53 are disposed along both left and right ends 13, 14 of a CF electrode substrate 10*a* such that the substrates are positioned perpendicularly to the plane of the left and right ends 13, 14. Thus, the light emission driving circuit substrates 53 face the respective scan electrode driving circuits 51*d* in the lateral direction thereof at light-emitting elements 52*d* thereof along the surface of the left and right ends 13, 14 of the CF electrode substrate 10*a* (side surfaces of the connection terminal portions).

As shown in FIGS. 21 and 23, instead of the scan electrode driving circuits 41*a* described in the second embodiment, four each scan electrode driving circuits 41*d* are disposed on both of the upper and lower ends 11, 12 of the common electrode substrate 10*b* of the liquid crystal panel 10 with the connection terminals of scan electrodes Y1 through Yn interposed therebetween. Thus, the scan electrode driving circuits 41*d* are directly electrically connected to the connection terminals of the respective scan electrodes Y1 through Yn.

As shown in FIGS. 21 and 23, each of the scan electrode driving circuits 41*d* includes a light-receiving element 45*a*. The light-receiving elements 45*a* are positioned to receive light from the light-emitting portions of the light-emitting elements 42*d* associated therewith, at light-receiving portions thereof, in parallel with the surface of each of the upper and lower ends 11, 12 of the common electrode substrate 10*b*.

Four each light-emitting elements 42*d* are disposed on the light emission driving circuit substrates 43 of the liquid crystal panel 10 at both upper and lower ends thereof in place of the light-emitting elements 42*a* described in the second embodiment to face the light-receiving elements 45*a* associated therewith.

As shown in FIGS. 21 and 22, instead of the signal electrode driving circuits 51*a* described in the second embodiment, four each signal electrode driving circuits 51*d* are disposed on both of the left and right ends 13, 14 of the CF electrode substrate 10*a* of the liquid crystal panel 10, with the connection terminals of signal electrodes X1 through Xm interposed therebetween. Thus, the signal electrode driving circuits 51*d* are directly electrically connected to the connection terminals of the respective signal electrodes X1 through Xm.

Each of the signal electrode driving circuits 51*d* includes a light-receiving element 55*a*. The light-receiving elements 55*a* of the signal electrode driving circuits 51*d* are positioned to receive light from the light-emitting portions of the light-emitting elements 52*d* associated therewith, at light-receiving portions thereof, in parallel with the surface of each of the left and right ends 13, 14 of the CF electrode substrate 10*a*.

Four each light-emitting elements 52*d* are disposed on the light emission driving circuit substrates 53 at both of the left and right ends of the CF electrode substrate 10*a* in place of the light-emitting elements 52*a* described in the second embodiment to face the light-receiving elements 55*a* associated therewith. The light-receiving and light-emitting elements in the scan electrode driving system 40*d* have the same optical characteristics as those of the scan electrode driving system 40*a* described in the second embodiment. Also, the light-receiving and light-emitting elements in the signal electrode driving system 50*d* have the same optical characteristics as those of the light-receiving and light-emitting elements of the signal electrode driving system 50*a* described in the second embodiment corresponding thereto. The configuration is otherwise the same as that of the second embodiment.

In the fifth embodiment, the light emission driving circuit substrates 43 of the scan electrode driving systems 40*d* and the light emission driving circuit substrates 53 of the signal electrode driving systems 50*d* are positioned perpendicularly to the surfaces of the common electrode substrate 10*b* and CF electrode substrate 10*a* respectively unlike the second embodiment, whereas the light-emitting and light-receiving elements associated with each other of the scan electrode driving systems 40*d* and the light-emitting and light-receiving elements associated with each other of the signal electrode driving systems 50*d* directly face each other as in the second embodiment. Therefore, it is still possible to reduce the distance between the light-emitting and light-receiving elements associated with each other as in the second embodiment.

The effects of the present embodiment are otherwise the same as the second embodiment.

Figure 24:
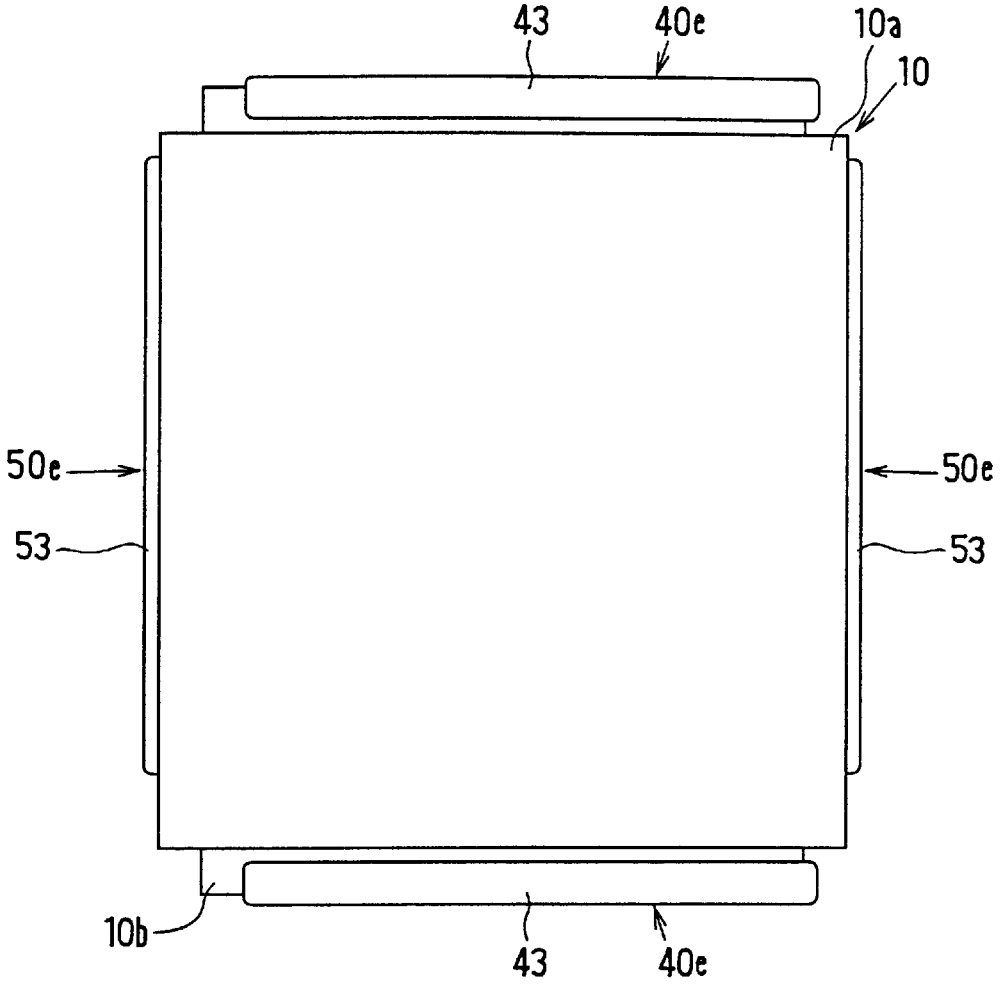
FIG. 24 is a plan view of a liquid crystal panel of a sixth embodiment of a liquid crystal display according to the present invention.
Figure 25:
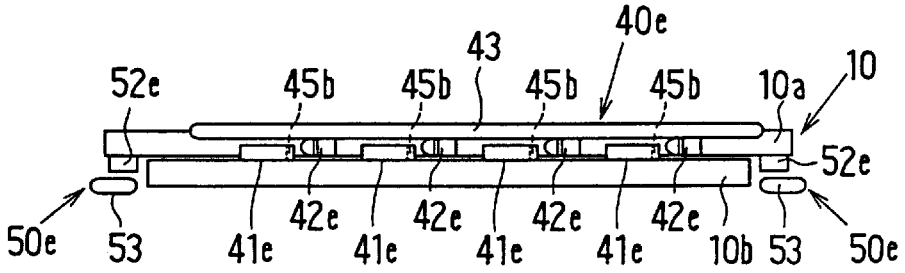
FIG. 25 is a bottom view of the liquid crystal panel of the sixth embodiment.
Figure 26:
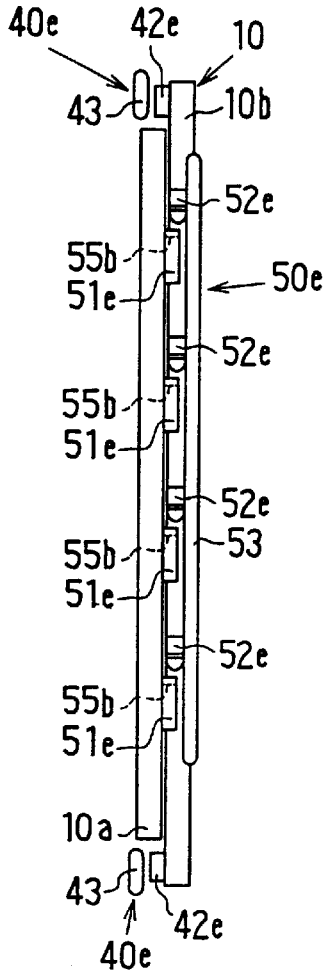
FIG. 26 is a right side view of the liquid crystal panel.

FIGS. 24 through 27 show the sixth embodiment of the invention. As shown in FIGS. 24 through 26, the scan electrode driving systems 40*e* are formed by replacing the scan electrode driving circuits 41*a* and light-emitting elements 42*a* in the scan electrode driving systems 40*a* of the second embodiment with scan electrode driving circuits 41*e* and light-emitting elements 42*e*, respectively. The signal electrode driving systems 50*e* are formed by replacing the signal electrode driving circuits 51*a* and light-emitting elements 52*a* in the signal electrode driving systems 50*a* described in the second embodiment with signal electrode driving circuits 51*e* and light-emitting elements 52*e*, respectively.

Figure 27:
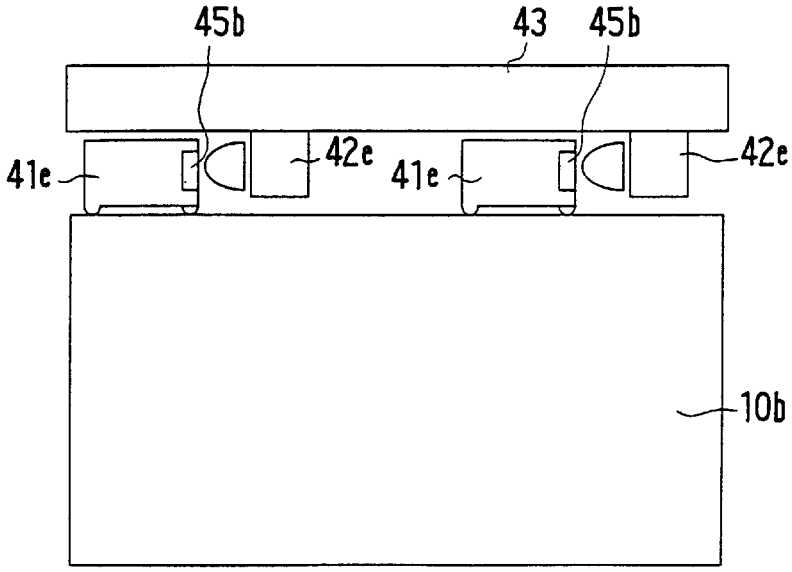
FIG. 27 is a partial enlarged bottom view of the liquid crystal panel.

As apparent from FIGS. 25 through 27, instead of the scan electrode driving circuits 41*a* described in the second embodiment, four each scan electrode driving circuits 41E are disposed on both upper and lower ends 11, 12 of a common electrode substrate 10*b* of a liquid crystal panel 10, with connection terminals of scan electrodes Y1 through Yn interposed therebetween. Thus, the scan electrode driving circuits 41*e* are directly electrically connected to the connection terminals of the respective scan electrodes Y1 through Yn.

As shown in FIGS. 25 and 27, each of the scan electrode driving circuits 41*e* includes a light-receiving element 45b. The light-receiving elements 45*b* are positioned in spaced-apart relationship on both of the upper and lower ends of the common electrode substrate 10*b* with light-receiving portions facing to the right in the figures. As a result, the light-receiving elements 45*b* receive light from light-emitting portions of the respective light-emitting elements 42*e* at the light-receiving portions in parallel with the surfaces of the upper and lower ends 11, 12 of the common electrode substrate 10*b*.

Four each light-emitting elements 42*e* are disposed on light emission driving circuit substrates 43 of the liquid crystal panel 10 at both of the upper and lower ends of the common electrode substrate 10*b* in place of the light-emitting elements 42*a* described in the second embodiment. The elements 42*e* face the light-receiving portions of the respective light-receiving elements 45*b* at light-emitting portions thereof. The light-emitting elements 42*e* are spaced from each other on the light emission driving circuit substrates 43 and are alternately positioned along common optical axes with the light-receiving elements 41*e*.

As shown in FIG. 26, instead of the signal electrode driving circuits 51*a* described in the second embodiment, four each signal electrode driving circuits 51*e* are disposed on both of left and right ends 13 and 14 of a CF electrode substrate 10*a*, with connection terminals of signal electrodes X1 through Xm interposed therebetween. Thus, the signal electrode driving circuits 51*e* are directly electrically connected to the connection terminals of the respective signal electrodes X1 through Xm.

Each of the signal electrode driving circuits 51*e* includes a light-receiving element 55*b*. The light-receiving elements 55*b* are spaced apart from one another and positioned on both of the left and right ends of the CF electrode substrate 10*a*, with light-receiving portions facing to the right in the FIG. 26. As a result, the light-receiving elements 55*b* receive light from light-emitting portions of the respective light-emitting elements 52*e* at light-receiving portions in parallel with surfaces of the left and right ends 13, 14 of the electrode substrate 10*a*.

Four each light-emitting elements 52*e* are disposed on light emission driving circuit substrates 53 at both of the left and right ends of the CF electrode substrate 10*a* in place of the light-emitting elements 52*a* described in the second embodiment. The elements 52*e* face the light-receiving portions of the light-receiving elements 55*b* associated therewith at light-emitting portions. The light-emitting elements 52*e* are spaced from each other on the light emission driving circuit substrates 53 and are positioned alternately along common optical axes with the light-receiving elements 51*e*.

In the sixth embodiment, the light-receiving and light-emitting elements in the scan electrode driving system 40*e* have the same optical characteristics as those of the light-receiving and light-emitting elements of the scan electrode driving system 40*a* described in the second embodiment. Also, the light-receiving and light-emitting elements in the signal electrode driving system 50*e* have the same optical characteristics as those of the light-receiving and light-emitting elements of the signal electrode driving system 50*a* of the second embodiment.

In the sixth embodiment, the associated light-emitting and light-receiving elements of the scan electrode driving systems 40*e* and the associated light-emitting and light-receiving elements of the signal electrode driving systems 50*e* directly face each other. Therefore, it is still possible to reduce the distance between these associated elements as in the second embodiment.

Further, the light-receiving and light-emitting elements in the scan electrode driving system 40*e* and in the signal electrode driving system 50*e* do not protrude from the planes of the common electrode substrate 10*b* and CF electrode substrate 10*a* of the liquid crystal panel 10, respectively, and are positioned within those planes. This makes it possible to achieve the desired effect as described above while minimizing the size of the liquid crystal frame area. The effects of the present embodiment are otherwise the same as the second embodiment.

In carrying out the present invention, the light-emitting elements 42, 52 and the light-receiving elements 44, 54 described in the first embodiment may alternatively be constituted by elements as described below.

If the four light-emitting elements 42 at the lower end 12 of the common electrode substrate 10*b* are referred to as first through fourth lower light-emitting elements 42 in the order starting with the leftmost light-emitting element 42 as viewed in FIG. 2, then each of the first and third lower light-emitting elements 42 may be a semiconductor laser oscillated in a visible region having a wavelength of 0.65 $\mu$m (AlGaInP type), and each of the second and fourth lower light-emitting elements 42 may be a semiconductor laser oscillated in a near infrared region having a wavelength of 1.6 $\mu$m (InAsP type).

Each of the first and third lower light-receiving elements 44 facing the first and third lower light-emitting elements 42 may be a CdSe element that exhibits high light-receiving sensitivity in the visible light region. Each of the second and fourth lower light-receiving elements 44 facing the second and fourth lower light-emitting elements 42 may be a PbSe element that exhibits high light-receiving sensitivity in an infrared region.

If the four light-emitting elements 42 located at the upper end 11 of the common electrode substrate 10*b* in association with the first through fourth lower light-emitting elements 42 are referred to as first through fourth upper light-emitting elements 42, then each of the first and third upper light-emitting elements 42 may be a semiconductor laser oscillated in a visible region as described above, and each of the second and fourth upper light-emitting elements 42 may be a semiconductor laser oscillated in a near infrared region as described above. Each of the first and third upper light-receiving elements 44 facing the first and third upper light-emitting elements 42 may be a CdSe element as described above. Each of the second and fourth upper light-receiving elements 44 facing the second and fourth upper light-emitting elements 42 may be a PbSe element as described above.

If the four light-emitting elements 52 at the right end 14 of the CF electrode substrate 10*a* are referred to as first through fourth right-side light-emitting elements 52 in the order starting with the uppermost light-emitting element 52 as viewed in FIG. 4, then each of the first and third right-side light-emitting elements 52 may be a semiconductor laser oscillated in a visible region as described above, and each of the second and fourth right-side light-emitting elements 52 may be a semiconductor laser oscillated in a near infrared region as described above.

Each of the first and third right-side light-receiving elements 54 facing the first and third right-side light-emitting elements 52 may be a CdSe element as described above, while each of the second and fourth right-side light-receiving elements 54 facing the second and fourth right-side light-emitting elements 52 may be a PbSe as described above.

If the four light-emitting elements 52 located at the left end 13 of the CF electrode substrate 10*a* in association with the first through fourth right-side light-emitting elements 52 are referred to as first through fourth left-side light-emitting elements 52, then each of the first and third left-side light-emitting elements 52 may be a semiconductor laser oscillated in a visible region as described above, and each of the second and fourth left-side light-emitting elements 52 may be a semiconductor laser oscillated in a near infrared region as described above.

Each of the first and third left-side light-receiving elements 54 facing the first and third left-side light-emitting elements 52 may be a CdSe element as described above, while each of the second and fourth left-side light-receiving elements 54 facing the second and fourth left-side light-emitting elements 52 may be a PbSe as described above.

Also, one of two adjacent pairs of light emitting element 42 and light-receiving element 44 facing each other in the scan electrode driving system 40 may be a combination of a semiconductor laser oscillated in a visible region as described above and a CdSe element as described above, whereas the other pair may be a combination of a semiconductor laser oscillated in an infrared region as described above and a PbSe element as described above.

In this case, since the wavelength of an optical synchronization signal as visible light from the semiconductor laser oscillated in a visible range differs from the wavelength of an optical synchronization signal as infrared light from the adjacent semiconductor laser oscillated in an infrared region, there is no mutual interference between the two optical synchronization signals.

Further, the CdSe element has high light-receiving sensitivity to visible light, and the PdSe element has high light-receiving sensitivity to infrared light. Therefore, the CdSe element and PbSe element differ from each other in terms of wavelength dependence.

Even when adjacent CdSe and PbSe elements respectively receive optical synchronization signals from a semiconductor laser oscillated in a visible region and a semiconductor laser oscillated in an infrared region, light-reception signals from the CdSe element and PbSe element are not affected by interference.

As described above, one of two adjacent pairs of light-emitting element 52 and light-receiving element 54 facing each other in the signal electrode driving system 50 may be a combination of a semiconductor laser oscillated in a visible region as described above and a CdSe element as described above, whereas the other pair may be a combination of a semiconductor laser oscillated in an infrared region as described above and a PbSe element as described above.

Therefore, no mutual interference occurs between two optical synchronization signals from a semiconductor laser oscillated in a visible region and a semiconductor laser oscillated in an infrared region which are adjacent to each other as in the scan electrode driving system 40. Further, even when both of a CdSe element and a PbSe element adjacent to each other receive respective optical synchronization signals from a semiconductor laser oscillated in a visible region and a semiconductor laser oscillated in an infrared region, similarly, light-reception signals from the CdSe element and PbSe element are not affected by interference.

The present invention is not limited to liquid crystal displays, and provides the same effects as those of the above-described embodiments when applied to matrix type EL displays utilizing an electroluminescent panel.

In the present invention, the light-emitting and light-receiving elements of two adjacent pairs of light emitting and light-receiving elements facing each other according to the second embodiment may be exchanged between the pairs.

Further, the present invention may be carried out with one of the polarizing plates 49*b*, 49*d* facing each other described in the fourth embodiment being deleted. This equally applies to the polarizing plates facing each other in the signal electrode driving systems 50*c*.

Also, each pair of light-emitting and light-receiving elements facing each other described in the first embodiment may be provided such that they directly face each other without interposing an end of the liquid crystal panel 10 therebetween.

Further, each pair of light-emitting and light-receiving elements facing each other described in the second through fourth embodiments may face each other with an end of the liquid crystal panel interposed between them instead of directly facing each other.

While the above description constitutes the preferred embodiment of the present invention, it should be appreciated that the invention may be modified without departing from the proper scope or fair meaning of the accompanying claims. Various other advantages of the present invention will become apparent to those skilled in the art after having the benefit of studying the foregoing text and drawings taken in conjunction with the following claims.

What is claimed is:

1. A matrix type display comprising:

a panel display including a matrix of display elements;

driving systems including a plurality of pairs of light-emitting elements and light-receiving elements for driving the matrix of display elements in response to a light reception signal generated by each of the light-receiving elements, and based on light from each of the respective light-emitting elements generated in accordance with an image signal;

wherein each of the plurality of pairs of light-emitting elements and light-receiving elements forms a signal transmission path; and wherein light emitted by a light-emitting element in a first signal transmission path has a wavelength that differs from that of light emitted by a light-emitting element in a second adjacent signal transmission path.

2. A matrix type display according to claim 1, wherein the light-emitting elements comprise semiconductor lasers.

3. A matrix type display comprising:

a panel display including a matrix of display elements;

driving systems including a plurality of pairs of light-emitting elements and light-receiving elements for driving the matrix of display elements in response to a light-reception signal generated by each of the light-receiving elements, and based on light from each of the respective light-emitting elements generated in accordance with an image signal;

wherein each of the plurality of pairs of light-emitting elements and light-receiving elements forms a signal transmission path;

wherein light emitted by a light-emitting element in a first signal transmission path has a wavelength that differs from that of light emitted by a light-emitting element in a second adjacent signal transmission path; and wherein the light emitted by the light-emitting element in the first signal transmission path has a visible-region wavelength, and the light emitted by the light-emitting element in the second adjacent signal transmission path has a non-visible-region wavelength.

4. A matrix type display comprising:

a panel display including a matrix of display elements;

driving systems including a plurality of pairs of light-emitting elements and light-receiving elements for driving the matrix of display elements in response to a light-reception signal generated by each of the light-receiving elements, and based on light from each of the respective light-emitting elements generated in accordance with an image signal;

wherein each of the plurality of pairs of light-emitting elements and light-receiving elements forms a signal transmission path;

where light emitted by a light-emitting element in a first signal transmission path has a wavelength that differs from that of light emitted by a light-emitting element in a second adjacent signal transmission path;

wherein the light emitted by the light-emitting element in the first signal transmission path has a visible-region wavelength, and the light emitted by the light-emitting element in the second adjacent signal transmission path has a non-visible-region wavelength; and wherein the light emitted by the light-emitting element in the second adjacent signal transmission path has an infrared-region wavelength.

5. A matrix type display comprising:

a panel display including a matrix of display elements;

driving systems including a plurality of pairs of light-emitting elements and light-receiving elements for driving the matrix of display elements in response to a light-reception signal generated by each of the light-receiving elements, and based on light from each of the respective light-emitting elements generated in accordance with an image signal;

wherein each of the plurality of pairs of light-emitting elements and light-receiving elements forms a signal transmission path;

wherein light emitted by a light-emitting element in a first signal transmission path has a wavelength that differs from that of light emitted by a light-emitting element in a second adjacent signal transmission path; and wherein a light-receiving element in the first signal transmission path differs in wavelength dependence from that of a light-receiving element in the second adjacent signal transmission path.

6. A matrix type display comprising:

a panel display including a matrix of display elements;

driving systems including a plurality of pairs of light-emitting elements and light-receiving elements for driving the matrix of display elements in response to a light-reception signal generated by each of the light-receiving elements, and based on light from each of the respective light-emitting elements generated in accordance with an image signal;

wherein each of the plurality of pairs of light-emitting elements and light-receiving elements forms a signal transmission path;

wherein light emitted by a light-emitting element in a first signal transmission path has a wavelength that differs from that of light emitted by a light-emitting element in a second adjacent signal transmission path;

wherein a light-receiving element in the first signal transmission path differs in wavelength dependence from that of a light-receiving element in the second adjacent signal transmission path; and wherein the light-receiving element in the first signal transmission path is a CdSe receiving element, and the light-receiving element in the second adjacent signal transmission path is a PbSe receiving element.

7. A matrix type display comprising:

a panel display;

driving systems including a plurality of pairs of light-emitting elements and light-receiving elements disposed on panel portions around the display for driving a matrix of display elements in response to a light-reception signal generated by each of the light-receiving elements based on light from each of the respective light-emitting elements generated in accordance with an image signal;

wherein signal transmission paths are formed by each of the plurality of pairs of light-emitting elements and light-receiving elements; and optical interference inhibiting members located between the light emitting element and light receiving element of each of the signal transmission paths for inhibiting signal interference from adjacent signal transmission paths;

wherein each of the interference inhibiting members is an optical filter; and a first optical filter in each pair of adjacent signal transmission paths has a wavelength dependence difference from that of a second adjacent optical filter.

8. A matrix type display according to claim 7, wherein the light-receiving elements are pin diodes.

9. A matrix type display comprising:

a panel display;

driving systems including a plurality of pairs of light-emitting elements and light-receiving elements disposed on panel portions around the display for driving a matrix of display elements in response to a light-reception signal generated by each of the light-receiving elements based on light from each of the respective light-emitting elements generated in accordance with an image signal;

wherein signal transmission paths are formed by each of the plurality of pairs of light-emitting elements and light-receiving elements; and optical interference inhibiting members located between the light emitting element and light receiving element of each of the signal transmission paths for inhibiting signal interference from adjacent signal transmission paths;

wherein each of the interference preventing members is an optical filter;

a first optical filter in each pair of adjacent signal transmission paths has a wavelength dependence different from that of a second adjacent optical filter; and wherein the first optical filter is a red-wavelength-region filter that passes only red-wavelength light emitted from a corresponding first light-emitting element to a corresponding first light-receiving element, and the second adjacent optical filter is a blue-wavelength-region filter that passes only blue-wavelength light emitted from a corresponding second light-receiving element to a corresponding second light-receiving element.

10. A matrix type display comprising:

a panel display;

driving systems including a plurality of pairs of light-emitting elements and light-receiving elements disposed on panel portions around the display for driving a matrix of display elements in response to a light-reception signal generated by each of the light-receiving elements based on light from each of the respective light-emitting elements generated in accordance with an image signal;

wherein signal transmission paths are formed by each of the plurality of pairs of light-emitting elements and light-receiving elements;

optical interference inhibiting members located between the light emitting element and light receiving element of each of the signal transmission paths for inhibiting signal interference from adjacent signal transmission paths; and wherein the interference inhibiting members are light-blocking cylinders.

11. A matrix type display according to claim 10 wherein the light-receiving elements are pin diodes.

12. A matrix type display comprising:

a panel display;

driving systems including a plurality of pairs of light-emitting elements and light-receiving elements disposed on panel portions around the display for driving a matrix of display elements in response to a light-reception signal generated by each of the light-receiving elements based on light from each of the respective light-emitting elements generated in accordance with an image signal;

wherein signal transmission paths are formed by each of the plurality of pairs of light-emitting elements and light-receiving elements;

optical interference inhibiting members located between the light emitting element and light receiving element of each of the signal transmission paths for inhibiting signal interference from adjacent signal transmission paths;

wherein the interference inhibiting members are light-blocking cylinders; and wherein the signal transmission paths include a plurality of scan-side signal transmission paths, and a plurality of signal-side transmission paths, and the light-blocking cylinders isolate the plurality of scan-side signal transmission paths from the plurality of signal-side transmission paths.

13. A matrix type display comprising:

a panel display;

driving systems including a plurality of pairs of light-emitting elements and light-receiving elements disposed on panel portions around the display for driving a matrix of display elements in response to a light-reception signal generated by each of the light-receiving elements based on light from each of the respective light-emitting elements generated in accordance with an image signal;

wherein signal transmission paths are formed by each of the plurality of pairs of light-emitting elements and light-receiving elements;

optical interference inhibiting members located between the light emitting element and light receiving element of each of the signal transmission paths for inhibiting signal interference from adjacent signal transmission paths; and wherein the light-emitting elements are semiconductor lasers oscillated in the near-infrared wavelength region.

14. A matrix type display according to claim 13, wherein the light-receiving elements are pin diodes.

15. A matrix type display comprising:

a panel display;

driving systems including a plurality of pairs of light-emitting elements and light-receiving elements disposed on panel portions around the display for driving a matrix of display elements in response to a light-reception signal generated by each of the light-receiving elements based on light from each of the respective light-emitting elements generated in accordance with an image signal;

wherein signal transmission paths are formed by each of the plurality of pairs of light-emitting elements and light-receiving elements;

optical interference inhibiting members located between the light emitting element and light receiving element of each of the signal transmission paths for inhibiting signal interference from adjacent signal transmission paths;

directivity-enhancing members in communication with each of the light-emitting elements for increasing directivity of the light emitted from the light-emitting elements; and wherein the light-emitting elements and the directivity-enhancing members are integrated together.

16. A matrix type display comprising:

a panel display;

driving systems including a plurality of pairs of light-emitting elements and light-receiving elements disposed on panel portions around the display for driving a matrix of display elements in response to a light-reception signal generated by each of the light-receiving elements based on light from each of the respective light-emitting elements generated in accordance with an image signal;

wherein signal transmission paths are formed by each of the plurality of pairs of light-emitting elements and light-receiving elements;

optical interference inhibiting members located between the light emitting element and light receiving element of each of the signal transmission paths for inhibiting signal interference from adjacent signal transmission paths;

wherein each of the interference inhibiting members is an optical filter;

directivity-enhancing members in communication with each of the light-emitting elements for increasing directivity of the light emitted from the light-emitting elements;

wherein the directivity-enhancing members are convex lenses; and wherein the light-emitting elements and the directivity-enhancing members are integrated together.

17. A matrix type display comprising:

a panel display;

driving systems including a plurality of pairs of light-emitting elements and light-receiving elements disposed on panel portions around the display for driving a matrix of display elements in response to a light-reception signal generated by each of the light-receiving elements based on light from each of the respective light-emitting elements generated in accordance with an image signal;

wherein signal transmission paths are formed by each of the plurality of pairs of light-emitting elements and light-receiving elements;

optical interference inhibiting members located between the light emitting element and light receiving element of each of the signal transmission paths for inhibiting signal interference from adjacent signal transmission paths;

wherein each of the interference inhibiting members is a polarizing plate; and a polarizing plate in a first of two adjacent signal transmission paths has a polarization axis different from that of a polarizing plate in a second of the two adjacent signal transmission paths.

18. A matrix type display according to claim 17, wherein the light-receiving elements are pin diodes.

19. A matrix type display comprising:

a panel display;

driving systems including a plurality of pairs of light-emitting elements and light-receiving elements disposed on panel portions around the display for driving a matrix of display elements in response to a light-reception signal generated by each of the light-receiving elements based on light from each of the respective light-emitting elements generated in accordance with an image signal;

wherein signal transmission paths are formed by each of the plurality of pairs of light-emitting elements and light-receiving elements;

optical interference inhibiting members located between the light emitting element and light receiving element of each of the signal transmission paths for inhibiting signal interference from adjacent signal transmission paths;

wherein a first light-emitting element in each of the plurality of pairs of light-emitting elements and light-receiving elements comprises a semiconductor laser oscillated in a visible wavelength region, and a corresponding first light-receiving element comprises a CdSe receiving element; and a second light-emitting element in each of the plurality of pairs of light-emitting elements and light-receiving elements comprises a semiconductor laser oscillated in a non-visible wavelength region, and a corresponding second light-receiving element comprises a PbSe receiving element.

20. A matrix type display comprising:

a panel display including a matrix of display elements;

driving systems including a plurality of pairs of light-emitting elements and light-receiving elements for driving the matrix of display elements in response to a light-reception signal generated by each of the light-receiving elements and based on light from each of the respective light-emitting elements generated in accordance with an image signal;

wherein each of the plurality of pairs of light-emitting elements and light-receiving elements forms a signal transmission path;

wherein the panel display includes:

a pair of substrates;

a peripheral substrate, separate and distinct from the pair of substrates;

wherein a first substrate of the pair of substrates includes the plurality of light-receiving elements that are arranged on the substrate to give a predetermined interval; and wherein the peripheral substrate is disposed in the periphery of the pair of substrates and includes the plurality of light-emitting elements that are arranged to give a predetermined interval, each of the light-emitting elements facing one of the light-receiving elements to make a plurality of pairs consisting of a light-emitting element and a light-receiving element, the plurality of pairs being arranged in a predetermined interval that does not cause an optical interference between a light-emitting element and a light-receiving element of adjacent pairs consisting of a light-emitting element and a light-receiving element.

* * * * *